US010844697B2

(12) United States Patent
Preiss et al.

(10) Patent No.: US 10,844,697 B2
(45) Date of Patent: Nov. 24, 2020

(54) PERFORATION GUN COMPONENTS AND SYSTEM

(71) Applicant: DynaEnergetics Europe GmbH, Troisdorf (DE)

(72) Inventors: Frank Haron Preiss, Bonn (DE); Liam McNelis, Bonn (DE); Eric Mulhern, Edmonton (CA); Thilo Scharf, Letterkenny (IE); David C. Parks, Calgary (CA)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 16/585,790

(22) Filed: Sep. 27, 2019

(65) Prior Publication Data

US 2020/0032626 A1 Jan. 30, 2020

Related U.S. Application Data

(60) Continuation of application No. 16/359,540, filed on Mar. 20, 2019, now Pat. No. 10,472,938, which is a (Continued)

(30) Foreign Application Priority Data

Jul. 18, 2013 (CA) ..... 2821506

(51) Int. Cl.
*E21B 43/1185* (2006.01)
*F42D 1/02* (2006.01)
(Continued)

(52) U.S. Cl.
CPC ..... *E21B 43/1185* (2013.01); *E21B 43/119* (2013.01); *E21B 43/11855* (2013.01);
(Continued)

(58) Field of Classification Search
CPC ..... E21B 43/1185; F42C 19/06; F41D 1/043
See application file for complete search history.

(56) References Cited

U.S. PATENT DOCUMENTS 2,216,359 A 10/1940 Spencer
2,358,466 A 9/1944 Miller
(Continued)

FOREIGN PATENT DOCUMENTS

CA 2821506 A1 1/2015
CN 85107897 A 9/1986
(Continued)

OTHER PUBLICATIONS

Dynaenergetics, Selection Perforating Switch, Product Information Sheet, May 27, 2011, 1 pg.
(Continued)

*Primary Examiner* — Joshua T Semick
(74) *Attorney, Agent, or Firm* — Moyles IP, LLC

(57) ABSTRACT

Components for a perforation gun system are provided including combinations of components including a self-centralizing charge holder system and a bottom connector that can double as a spacer. Any number of spacers can be used with any number of holders for any desired specific metric or imperial shot density, phase and length gun system.

21 Claims, 18 Drawing Sheets

Related U.S. Application Data continuation of application No. 15/920,812, filed on Mar. 14, 2018, which is a continuation of application No. 15/617,344, filed on Jun. 8, 2017, now Pat. No. 10,429,161, which is a division of application No. 15/287,309, filed on Oct. 6, 2016, now Pat. No. 9,702,680, which is a division of application No. 14/904,788, filed as application No. PCT/CA2014/050673 on Jul. 16, 2014, now Pat. No. 9,494,021.

(51) Int. Cl.
*F42D 1/04* (2006.01)
*E21B 43/119* (2006.01)
*F42C 19/06* (2006.01)

(52) U.S. Cl.
CPC ..... *F42C 19/06* (2013.01); *F42D 1/02* (2013.01); *F42D 1/04* (2013.01); *F42D 1/043* (2013.01)

(56) References Cited

U.S. PATENT DOCUMENTS 2,418,486 A 4/1947 Smylie
2,598,651 A 5/1952 Spencer
2,958,651 A 5/1952 Spencer
2,889,775 A 6/1959 Owen
3,158,680 A 11/1964 Lovitt et al.
3,170,400 A 2/1965 Nelson
3,246,707 A 4/1966 Bell
3,374,735 A 3/1968 Moore
3,504,723 A 4/1970 Cushman et al.
3,859,921 A 1/1975 Stephenson
4,007,790 A 2/1977 Henning
4,007,796 A 2/1977 Boop
4,058,061 A 11/1977 Mansur, Jr. et al.
4,140,188 A 2/1979 Vann
4,182,216 A 1/1980 DeCaro
4,266,613 A * 5/1981 Boop ..... F42D 1/04 166/299
4,290,486 A 9/1981 Regalbuto
4,491,185 A 1/1985 McClure
4,496,008 A 1/1985 Pottier et al.
4,523,650 A 6/1985 Sehnert et al.
4,574,892 A 3/1986 Grigar et al.
4,598,775 A 7/1986 Vann et al.
4,621,396 A 11/1986 Walker et al.
4,650,009 A 3/1987 McClure et al.
4,657,089 A 4/1987 Stout
4,660,910 A 4/1987 Sharp et al.
4,744,424 A 5/1988 Lendermon et al.
4,747,201 A 5/1988 Donovan et al.
4,753,170 A 6/1988 Regallbuto et al.
4,776,393 A 10/1988 Forehand et al.
4,790,383 A 12/1988 Savage et al.
4,800,815 A 1/1989 Appledom et al.
4,852,494 A 8/1989 Williams
4,889,183 A 12/1989 Sommers et al.
5,027,708 A * 7/1991 Gonzalez ..... E21B 43/1185 102/202.1
5,052,489 A 10/1991 Carisella et al.
5,060,573 A 10/1991 Montgomery et al.
5,088,413 A 2/1992 Huber
5,105,742 A 4/1992 Sumner
5,159,145 A 10/1992 Carisella et al.
5,159,146 A 10/1992 Carisella et al.
5,241,891 A 9/1993 Hayes et al.
5,322,019 A 6/1994 Hyland
5,347,929 A 9/1994 Lerche et al.
5,358,418 A 10/1994 Carmichael
5,392,851 A 2/1995 Arend
5,392,860 A 2/1995 Ross
5,436,791 A 7/1995 Turano et al.
5,582,251 A 12/1996 Bailey et al.
5,603,384 A 2/1997 Bethel et al.
5,703,319 A 12/1997 Fritz et al.
5,775,426 A 7/1998 Snider et al.
5,816,343 A 10/1998 Markel et al.
5,871,052 A 2/1999 Benson et al.
5,992,289 A 11/1999 George et al.
6,006,833 A 12/1999 Burleson et al.
6,012,525 A 1/2000 Burleson et al.
6,085,659 A 7/2000 Beukes et al.
6,112,666 A 9/2000 Murray et al.
6,298,915 B1 10/2001 George
6,305,287 B1 10/2001 Capers et al.
6,354,374 B1 3/2002 Edwards et al.
6,418,853 B1 7/2002 Duguet et al.
6,651,747 B2 11/2003 Chen et al.
6,739,265 B1 5/2004 Badger et al.
6,742,602 B2 6/2004 Trotechaud
6,752,083 B1 6/2004 Lerche et al.
6,843,317 B2 1/2005 MacKenzie
7,107,908 B2 9/2006 Forman et al.
7,193,527 B2 3/2007 Hall
7,237,626 B2 7/2007 Gurjar et al.
7,278,491 B2 10/2007 Scott
7,347,278 B2 3/2008 Lerche et al.
7,364,451 B2 4/2008 Ring et al.
7,510,017 B2 3/2009 Howell et al.
7,568,429 B2 8/2009 Hummel et al.
7,726,396 B2 6/2010 Briquet et al.
7,762,172 B2 7/2010 Li et al.
7,762,351 B2 7/2010 Vidal
7,778,006 B2 8/2010 Stewart et al.
7,810,430 B2 10/2010 Chan et al.
7,901,247 B2 3/2011 Ring
7,908,970 B1 3/2011 Jakaboski et al.
7,929,270 B2 4/2011 Hummel et al.
7,980,874 B2 7/2011 Finke et al.
8,066,083 B2 11/2011 Hales et al.
8,069,789 B2 12/2011 Hummel et al.
8,074,737 B2 12/2011 Hill et al.
8,127,846 B2 3/2012 Hill et al.
8,157,022 B2 4/2012 Bertoja et al.
8,181,718 B2 5/2012 Burleson et al.
8,182,212 B2 5/2012 Parcell
8,186,259 B2 5/2012 Burleson et al.
8,256,337 B2 9/2012 Hill
8,395,878 B2 3/2013 Stewart et al.
8,451,137 B2 5/2013 Bonavides et al.
8,469,087 B2 6/2013 Gray
8,661,978 B2 3/2014 Backhus et al.
8,695,506 B2 4/2014 Lanclos
8,863,665 B2 * 10/2014 DeVries ..... F41A 19/69 102/206
8,869,887 B2 10/2014 Deere et al.
8,875,787 B2 * 11/2014 Tassaroli ..... E21B 43/1185 166/297
8,881,816 B2 11/2014 Glenn et al.
9,080,433 B2 7/2015 Lanclos et al.
9,145,764 B2 * 9/2015 Burton ..... F42D 1/043
9,181,790 B2 11/2015 Mace et al.
9,194,219 B1 11/2015 Hardesty et al.
9,206,675 B2 12/2015 Hales et al.
9,284,819 B2 3/2016 Tolman et al.
9,476,289 B2 * 10/2016 Wells ..... E21B 33/134
9,494,021 B2 11/2016 Parks et al.
9,518,454 B2 12/2016 Current et al.
9,581,422 B2 2/2017 Preiss et al.
9,598,942 B2 3/2017 Wells et al.
9,605,937 B2 3/2017 Eitschberger et al.
9,634,427 B2 4/2017 Lemer et al.
9,677,363 B2 * 6/2017 Schacherer ..... E21B 29/02
9,689,223 B2 6/2017 Schacherer et al.
9,784,549 B2 10/2017 Eitschberger
9,903,192 B2 2/2018 Entchev et al.
10,066,921 B2 9/2018 Eitschberger
10,077,641 B2 9/2018 Rogman et al.
10,138,713 B2 11/2018 Tolman et al.
10,151,180 B2 12/2018 Robey et al.
10,188,990 B2 1/2019 Burmeister et al.
10,190,398 B2 1/2019 Goodman et al.

(56) References Cited

U.S. PATENT DOCUMENTS

| | | | |
|---|---|---|---|
| 10,352,144 | B2 | 7/2019 | Entchev et al. |
| 10,458,213 | B1 | 10/2019 | Eitschberger et al. |
| 2002/0020320 | A1 | 2/2002 | Lebaudy et al. |
| 2002/0062991 | A1 | 5/2002 | Farrant et al. |
| 2003/0000411 | A1 | 1/2003 | Cernocky et al. |
| 2003/0001753 | A1 | 1/2003 | Cernocky et al. |
| 2005/0178282 | A1 | 8/2005 | Brooks et al. |
| 2005/0186823 | A1 | 8/2005 | Ring et al. |
| 2005/0194146 | A1 | 9/2005 | Barker et al. |
| 2005/0229805 | A1 | 10/2005 | Myers, Jr. et al. |
| 2007/0084336 | A1 | 4/2007 | Neves |
| 2007/0125540 | A1 | 6/2007 | Gerez et al. |
| 2007/0158071 | A1 | 7/2007 | Mooney et al. |
| 2008/0047456 | A1 | 2/2008 | Li et al. |
| 2008/0110612 | A1 | 5/2008 | Prinz et al. |
| 2008/0134922 | A1 | 6/2008 | Grattan et al. |
| 2008/0149338 | A1 | 6/2008 | Goodman et al. |
| 2008/0173204 | A1 | 7/2008 | Anderson et al. |
| 2008/0264639 | A1 | 10/2008 | Parrott et al. |
| 2009/0050322 | A1 | 2/2009 | Hill et al. |
| 2009/0272529 | A1 | 11/2009 | Crawford |
| 2009/0301723 | A1 | 12/2009 | Gray |
| 2010/0000789 | A1 | 1/2010 | Barton et al. |
| 2010/0089643 | A1 | 4/2010 | Vidal |
| 2010/0096131 | A1 | 4/2010 | Hill et al. |
| 2010/0163224 | A1 | 7/2010 | Strickland |
| 2010/0230104 | A1 | 9/2010 | Noelke et al. |
| 2011/0024116 | A1 | 2/2011 | McCann et al. |
| 2012/0085538 | A1 | 4/2012 | Guerrero et al. |
| 2012/0199031 | A1 | 8/2012 | Lanclos |
| 2012/0199352 | A1 | 8/2012 | Lanclos et al. |
| 2012/0241169 | A1 | 9/2012 | Hales et al. |
| 2012/0242135 | A1 | 9/2012 | Thomson et al. |
| 2012/0247769 | A1 | 10/2012 | Schacherer et al. |
| 2012/0247771 | A1 | 10/2012 | Black et al. |
| 2012/0298361 | A1 | 11/2012 | Sampson |
| 2013/0008639 | A1 | 1/2013 | Tassaroli |
| 2013/0062055 | A1 | 3/2013 | Tolman et al. |
| 2013/0118342 | A1 | 5/2013 | Tassaroli |
| 2013/0199843 | A1 | 8/2013 | Ross |
| 2013/0248174 | A1 | 9/2013 | Dale et al. |
| 2014/0131035 | A1 | 5/2014 | Entchev et al. |
| 2015/0176386 | A1 | 6/2015 | Castillo et al. |
| 2015/0226044 | A1 | 8/2015 | Ursi et al. |
| 2015/0330192 | A1 | 11/2015 | Rogman et al. |
| 2016/0040520 | A1 | 2/2016 | Tolman et al. |
| 2016/0061572 | A1 | 3/2016 | Eitschberger et al. |
| 2016/0069163 | A1 | 3/2016 | Tolman et al. |
| 2016/0084048 | A1 | 3/2016 | Harrigan et al. |
| 2016/0168961 | A1 | 6/2016 | Parks et al. |
| 2016/0273902 | A1 | 9/2016 | Eitschberger |
| 2016/0356132 | A1 | 12/2016 | Burmeister et al. |
| 2017/0030693 | A1 | 2/2017 | Preiss et al. |
| 2017/0145798 | A1 | 5/2017 | Robey et al. |
| 2017/0211363 | A1 | 7/2017 | Bradley et al. |
| 2017/0241244 | A1 | 8/2017 | Barker et al. |
| 2017/0268860 | A1 | 9/2017 | Eitschberger |
| 2017/0314372 | A1 | 11/2017 | Tolman et al. |
| 2018/0030334 | A1 | 2/2018 | Collier et al. |
| 2018/0135398 | A1 | 5/2018 | Entchev et al. |
| 2018/0209251 | A1 | 7/2018 | Robey et al. |
| 2018/0274342 | A1 | 9/2018 | Sites |
| 2018/0299239 | A1 | 10/2018 | Eitschberger et al. |
| 2018/0306010 | A1 | 10/2018 | Von Kaenel et al. |
| 2018/0318770 | A1 | 11/2018 | Eitschberger et al. |
| 2019/0040722 | A1 | 2/2019 | Yang et al. |
| 2019/0048693 | A1 | 2/2019 | Henke et al. |
| 2019/0049225 | A1 | 2/2019 | Eitschberger |
| 2019/0085685 | A1 | 3/2019 | McBride |
| 2019/0195054 | A1 | 6/2019 | Bradley et al. |
| 2019/0211655 | A1 | 7/2019 | Bradley et al. |
| 2019/0284889 | A1 | 9/2019 | Lagrange et al. |
| 2019/0292887 | A1 | 9/2019 | Austin, II et al. |
| 2019/0316449 | A1 | 10/2019 | Schultz et al. |

FOREIGN PATENT DOCUMENTS

| | | | |
|---|---|---|---|
| CN | 101397890 | A | 4/2009 |
| CN | 201620848 | U | 11/2010 |
| RU | 2489567 | C1 | 8/2013 |
| RU | 2633904 | C1 | 10/2017 |
| WO | 2001059401 | A1 | 8/2001 |
| WO | 2009091422 | A2 | 7/2009 |
| WO | 2012006357 | A2 | 1/2012 |
| WO | 2015006869 | A1 | 1/2015 |
| WO | 2015134719 | A1 | 9/2015 |
| WO | 2015134719 | A8 | 9/2015 |
| WO | 2018009223 | A1 | 1/2018 |
| WO | 2018067598 | A1 | 4/2018 |
| WO | 2019148009 | A2 | 8/2019 |

OTHER PUBLICATIONS

Dynaenergetics, Electronic Top Fire Detonator, Product Information Sheet, Jul. 30, 2013 1 pg.

German Patent Office, Office Action dated May 22, 2014, in German: See Office Action for German Patent Application No. 10 2013 109 227.6, which is in the same family as PCT Application No. PCT/EP2014/065752, 8 pgs.

PCT Search Report and Written Opinion, dated May 4, 2015: See Search Report and Written opinion for PCT Application No. PCT/EP2014/065752, 12 pgs.

SIPO, Search Report dated Mar. 29, 2017, in Chinese: See Search Report for CN App. No. 201480040456.9, which is in the same family as PCT App. No. PCT/CA2014/050673, 12 & 3 pgs.

Jim Gilliat/Kaled Gasmi, New Select-Fire System, Baker Hughes, Presentation—2013 Asia-Pacific Perforating Symposium, Apr. 29, 2013, 16 pgs., http://www.perforators.org/presentations.php.

Dynaenergetics, DYNAselect Electronic Detonator 0015 SFDE RDX 1.4S, Product Information, Dec. 16, 2011, 1 pg.

Dynaenergetics, DYNAselect Electronic Detonator 0015 SFDE RDX 1.4B, Product Information, Dec. 16, 2011, 1 pg.

Austin Powder Company, A—140 F & Block, Detonator & Block Assembly, 2 pgs.

Owen Oil Tools & Pacific Scientific; Side Block for Side Initiation, 1 pg.

SIPO, Office Action dated Jun. 27, 2018: See Office Action for CN App. No. 201580011132.7, which is in the same famil as PCT App. No. PCT/US2015/18906, 9 pgs. & 5 pgs.

Amit Govil, Selective Perforation: A Game Changer in Perforating Technology—Case Study, presented at the 2012 European and West African Perforating Symposium, Schlumberger, Nov. 7-9, 2012, 14 pgs.

Dynaenergetics, DYNAselect System, information downloaded from website, Jul. 3, 2013, 2 pgs., http://www.dynaenergetics.com/.

GB Intellectual Property Office, Search Report for App. No. GB 1700625.5, which is in the same family as U.S. Pat. No. 9,494,021, dated Jul. 7, 2017, 5 pgs.

International Search Report and Written Opinion of International Application No. PCT/US2015/018906, dated Jul. 10, 2015, 12 pgs.

Dynaenergetics, Gun Assembly, Products Summary Sheet, May 7, 2004, 1 pg.

GB Intellectual Property Office, Office Action dated Feb. 27, 2018, See Office Action for App. No. GB 1717516.7, which is the same family as PCT App. No. PCT/CA2014/050673, 6 pg.

Dynaenergetics, Selective Perforating Switch, information downloaded from website, Jul. 3, 2013, 2 pgs.,http://www.dynaenergetics.com/.

Hunting Titan, Wireline Top Fire Detonator Systems, Product Information Sheet, 1 pg.

Hunting Titan Inc., Petition for Inter Parties Review of U.S. Pat. No. 9,581,422, filed Feb. 16, 2018, 93 pgs.

Dynaenergetics GMBH & Co. KG, Patent Owner's Response to Hunting Titan's Petition for Inter Parties Review, filed Dec. 6, 2018, 73 pgs.

Dynaenergetics GMBH & Co. KG, Patent Owner's Motion to Amend, filed Dec. 6, 2018, 53 pgs.

(56) References Cited

OTHER PUBLICATIONS

U.S. Patent Trial and Appeal Board, Institution of Inter Partes Review, Case IPR2018-00600, issued on Aug. 21, 2018, 9 pgs.
International Written Opinion of International Application No. PCT/CA2014/050673, dated Oct. 9, 2014, 4 pgs.
International Search Report of International Application No. PCT/CA2014/050673, dated Oct. 9, 2014, 3 pgs.
UK Examination Report of United Kingdom Patent Application No. GB1600085.3, which is in the same family as U.S. Pat. No. 9,494,021, dated Mar. 9, 2016, 1 pg.
FIIP, Search Report dated Feb. 1, 2018, in Russian: See Search Report for RU App. No. 2016104882/03, which is in the same family as PCT App. No. PCT/CA2014/050673, 7 pgs.
FIIP, Search Report dated Feb. 1, 2018, in English See Search Report for RU App. No. 2016104882/03, which is in the same family as PCT App. No. PCT/CA2014/050673, 4 pages.
Norwegan Industrial Property Office, Office Action for NO Patent App. No. 20160017, which is in the same family as PCT App No. PCT/CA2014/050673, dated Jun. 15, 2017, 3 pgs.
Jet Research Center Inc., Red RF Safe Detonators Brochure, 2008, 2 pgs., www.jetresearch.com.
Jet Research Center Inc., JRC Catalog, 36 pgs., www.jetresearch.com.
Horizontal Wireline Services, Presentation of a completion method of shale demonstrated through an axample of Marcellus Shale, Pennsylvania, USA, Presented at 2012 International Perforating Symposium (Apr. 26-28, 2012), 17 pages.
Smylie, New Safe and Secure Detonators for the Industry's consideration, Presented at Explosives Safety & Security Conference Marathon Oil Co, Houston, Feb. 23-24, 2005, 20 pages.
Schlumberger, Combining and Customizing Technologies for Perforating Horizontal Wells in Algeria, Presented at 2011 MENAPS Middle East and North Africa Perforating Symposium, Nov. 28-30, 2011, 20 pages.
Baker Hughes, Long Gun Deployment Systems IPS-12-28, Presented at 2012 International Perforating Symposium, Apr. 26-28, 2011, 11 pages.
Owen Oil Tools, Recommended Practice for Oilfield Explosive Safety, Presented at 2011 MENAPS Middle East and North Africa Perforating Symposium, Nov. 28-30, 2011, 6 pages.
Norwegan Industrial Property Office, Search Report for NO Patent App. No. 20160017, which is in the same family as PCT App No. PCT/CA2014/050673, dated Jun. 15, 2017, 2 pgs.
Intellectual Property India, Office Action of IN Application No. 201647004496, dated Jun. 7, 2019, which is in the same family as PCT App No. PCT/CA2014/050673, 6 pgs.
United States Patent and Trademark Office, Non-final Office Action of U.S. Appl. No. 16/451,440, dated Oct. 24, 2019, 22 pgs.
United States Patent and Trademark Office, Non-final Office Action of U.S. Appl. No. 16/455,816, dated Nov. 5, 2019, 17 pgs.
United States Patent and Trademark Office, Non-final Office Action of U.S. Appl. No. 16/451,440, dated Dec. 24, 2019, 22 pgs.
United States Patent and Trademark Office, Non-final Office Action of U.S. Appl. No. 16/542,890, dated Nov. 4, 2019, 16 pgs.
International Search Report and Written Opinion of International App. No. PCT/EP2019/072064, dated Nov. 20, 2019, 15 pgs.
Norwegian Industrial Property Office, Office Action for NO Patent App. No. 20171759, which is in the same family as U.S. Appl. No. 16/585,790, dated Jan. 14, 2020, 4 pgs.
Norwegian Industrial Property Office, Search Report for NO Patent App. No. 20171759, which is in the same family as U.S. Appl. No. 16/585,790, dated Jan. 14, 2020, 2 pgs.
Baker Hughes, SurePerf Rapid Select-Fire System, Perforate production zones in a single run, Sep. 2012, 2 pgs, www.bakerhughes.com.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
IPR2018-00600, Exhibit 3001, Patent Owner's Precedential Opinion Panel Request Letter in regard to Case IPR2018-00600 for U.S. Pat. No. 9,581,422 B2, dated Sep. 18, 2019, 2 pg.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, DynaEnergetics GmbH & Co. Kg's Patent Owner Preliminary Response, dated May 22, 2018, 47 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.
United States Patent and Trademark Office, Case IPR2018-00600 for U.S. Pat. No. 9,581,422 B2, Petitioners Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioners Reply in Inter Partes Review of U.S. Pat. No. 9,581,422, dated Mar. 7, 2019, 44 pgs.
United States Patent and Trademark Office, Case IPR2018-00600 for U.S. Pat. No. 9,581,422 B2, Reply in Support of Patent Owner's Motion to Amend, dated Mar. 21, 2019, 15 pgs.
Brazilian Patent and Trademark Office; Search Report for BR Application No. BR112015033010-0; dated May 3,2020; (4 pages).
Canadian Intellectual Property Office; Office Action for CA Appl. No. 2,821,506; dated Mar. 21, 2019; 4 pages.
EP Patent Office—International Searching Authority, PCT Search Report and Written Opinion for PCT Application No. PCT/EP2014/065752, dated May 4, 2015, 12 pgs.
Eric H. Findlay, Jury Trial Demand in Civil Action No. 6:20-cv-00069-ADA, dated Apr. 22, 2020, 32 pages.
European Patent Office; Office Action for EP App. No. 15721178.0; dated Sep. 6, 2018; 5 pages.
Federal Institute of Industrial Property; Decision of Granting for RU Appl. No. 2016104882/03(007851); May 17, 2018; 15 pages. (English translation 4 pages).
Federal Institute of Industrial Property; Decision on Granting a Patent for Invention Russian App. No. 2016139136/03(062394); dated Nov. 8, 2018; 20 pages (Eng Translation 4 pages); Concise Statement of Relevance: Search Report at 17-18 of Russian-language document lists several 'A' references based on RU application claims.
Federal Institute of Industrial Property; Inquiry for RU App. No. 2016104882/03(007851); dated Feb. 1, 2018; 7 pages, English Translation 4 pages.
Federal Institute of Industrial Property; Inquiry for RU Application No. 2016110014/03(015803), dated Feb. 1, 2018, 6 pages. (Eng. Translation 4 pages).
GB Intellectual Property Office; Examination Report for GB Appl. No. 1717516.7, dated Apr. 13, 2018, 3 pages.
GB Intellectual Property Office; Search Report for GB. Appl. No. 1700625.5, dated Dec. 21, 2017, 5 pages.
Industrial Property Office, Czech Republic; Office Action for CZ App. No. PV 2017-675; Jul. 18, 2018; 2 pages; Concise Statement

(56) References Cited

OTHER PUBLICATIONS of Relevance: Examiner's objection of CZ application claims 1, 7, and 16 based on US Pub No. 20050194146 alone or in combination with WO Pub No. 2001059401.
International Searching Authority, International Preliminary Report on Patentability for PCT App. No. PCT/EP2014/065752; dated Mar. 1, 2016, 10 pgs.
International Searching Authority, International Search Report and Written Opinion for PCT App. No. PCT/IB2019/000526, dated Sep. 25, 2019, 17 pgs.
International Searching Authority, International Search Report and Written Opinion for PCT App. No. PCt/IB2019/000569; dated Oct 9, 2019, 12 pages.
International Searching Authority; International Preliminary Report on Patentability for PCT Appl. No. PCT/CA2014/050673, dated Jan. 19, 2016, 5 pages.
International Searching Authority; International Search Report and Written Opinion for PCT App. No. PCT/EP2015/059381, dated Nov. 23, 2015, 14 pages.
International Searching Authority; International Search Report and Written Opinion for PCT App. No. PCT/EP2019/066919, dated Sep. 10, 2019, 11 pages.
International Searching Authority; International Search Report and Written Opinion for PCT App. No. PCT/EP2019/069165, dated Oct 22, 2019, 13 pages.
Nexus Perforating; Double Nexus Connect; 1 page, https://www.nexuspeiforating.com/double-nexus-connect.
Norwegian Industrial Property Office; Opinion for NO Appl. No. 20171759, dated Apr. 5, 2019, 1 page.
Robert Parrott, Case IPR2018-00600 for U.S. Pat. No. 9,581,422 B2, Declaration regarding Patent Invalidity, dated Jun. 29, 2020, 146 pages.
Schulumberger, Perforating Services Catalog, 2008, 521 pages.
State Intellectual Property Office People'S Republic of China, First Office Action for Chinese App. No. 201811156092.7, dated Jun. 16, 2020, 6 pages. (Eng Translation 8 pages).
State Intellectual Property Office, P.R. China; First Office Action with full translation for CN App. No. 201480040456.9, dated Mar. 29, 2017, 12 pages. (English translation 17 pages).
State Intellectual Property Office, P.R. China; Second Office Action for CN App. No. 201480040456.9, dated Nov. 29, 2017, 5 pages (English translation 1 page).
United States Patent and Trademark Office, Case IPR2018-00600 for U.S. Pat. No. 9,581,422 B2, Patent Owner's Decision, Granting Patent Owner's Request for Hearing and Granting Patent Owner's Motion to Amend, dated Jul. 6, 2020, 27 pgs.
United States Patent and Trademark Office, Case PGR 2020-00072 for U.S. Pat. No. 10,429,161 B2, Petition for Post Grant Review of Claims 1-20 of U.S. Patent No. 10,429,161 Under 35 U.S.C. §§ 321-28 and 37 C.F. R. §§42.200 ET SEQ., dated Jun. 30, 2020, 109 pages.
United States Patent and Trademark Office, Non-final Office Action of U.S. Appl. No. 16/455,816, dated Jul. 2, 2020, 15 pgs.
United States Patent and Trademark Office, Office Action of U.S. Appl. No. 14/767,058, dated Jul. 15, 2016, 9 pgs.
United States Patent and Trademark Office, Office Action of U.S. Appl. No. 15/117,228, dated May 31, 2018, 9 pgs.
United States Patent and Trademark Office, Office Action of U.S. Appl. No. 15/617,344, dated Jan 23, 2019, 5 pgs.
United States Patent and Trademark Office, Office Action of U.S. Appl. No. 15/788,367, dated Oct. 22, 2018, 6 pgs.
United States Patent and Trademark Office, Office Action of U.S. Appl. No. 15/920,800, dated Dec. 27, 2019, 6 pgs.
United States Patent and Trademark Office, Office Action of U.S. Appl. No. 15/920,812, dated Dec. 27, 2019, 6 pgs.
United States Patent and Trademark Office, Office Action of U.S. Appl. No. 15/920,812, dated May 27, 2020, 5 pgs.
United States Patent and Trademark Office, Office Action of U.S. Appl. No. 16/026,431, dated Jul. 30, 2019, 10 pgs.
United States Patent and Trademark Office, Office Action of U.S. Appl. No. 16/272,326, dated May 24, 2019, 17 pgs.
United States Patent and Trademark Office, Office Action of U.S. Appl. No. 16/359,540, dated Aug. 14, 2019, 9 pgs.
United States Patent and Trademark Office, Office Action of U.S. Appl. No. 16/359,540, dated May 3, 2019, 11 pgs.
United States Patent and Trademark Office, Office Action of U.S. Appl. No. 16/455,816, dated Jan. 13, 2020, 14 pgs.
United States Patent and Trademark Office, Office Action of U.S. Appl. No. 16/540,484, dated Oct. 4, 2019, 12 pgs.
United States Patent and Trademark Office, Office Action of U.S. Appl. No. 16/858,041, dated Jun. 16, 2020, 11 pgs.
United States Patent and Trademark Office, Office Action of U.S. Appl. No. 29/733,080, dated Jun. 26, 2020, 8 pgs.
United States Patent and Trademark Office; Ex Parte Quayle Action for U.S. Appl. No. 29/729,981; dated Jun. 15, 2020; 6 pages.
United States Patent and Trademark Office; Final Office Action for U.S. Appl. No. 16/451,440; dated Feb. 7, 2020; 11 pages.
United States Patent and Trademark Office; Final Office Action for U.S. Appl. No. 16/542,890; dated May 12, 2020; 16 pages.
United States Patent and Trademark Office; Notice of Allowance for U.S. Appl. No. 16/387,696; dated Jan. 29, 2020; 7 pages.
United States Patent and Trademark Office; Notice of Allowance for U.S. Appl. No. 16/451,440; dated Jun. 5, 2020; 8 pages.
USPTO; Notice of Allowance for U.S. Appl. No. 14/904,788; dated Jul. 6, 2016; 8 pages.
CA PO Office Action for CA Appl. No. 3,015,102 dated Jun. 17, 2019 (4 pages).
Canada PO Office Action in CA Appl. No. 2,923,860 dated Jul. 14, 2017 (3 pages).
Canadian Intellectual Property Office, Office Action for CA App. No. 2923860 dated Nov. 25, 2016, 3 pages.
FIIP; Decision on Granting issued re RU Application No. 2016109329103 (11 pages); dated Oct. 21, 2019; (English translation 4 pages).
FIIP; Decision on Granting issued re RU Application No. 2019137475103 (15 pages); dated May 12, 2020; (English translation 4 pages).
United States Patent and Trademark Office, Office Action of U.S. Appl. No. 16/809,729, dated Jun. 19, 2020, 9 pgs.
NIPA, PR China, First Office Action of CN Appl. No. 201610153426.X dated Mar. 20, 2019 (Chinese 6 pages); English translation (11 pages).
Owen Oil Tools, E & B Select Fire Side Port, Tandem Sub, Apr. 2010, 2 pgs., https://www.corelab.com/owen/cms/ docs/Canada/10A_eandbsystem-01.0-c.pdf.
Owen Oil Tools, Expendable Perforating Guns, Jul. 2008, 7 pgs., https://www.corelab.com/owen/cms/docs/ Canada/10A_erhsc-01.0-c.pdf.
Owens Oil Tools, E & B Select Fire Side Port Tandem Sub Assembly, Dec. 2012, 9 pgs., https://www.corelab.com/owen/CMS/docs/Manuals/gunsys/Man-30-Xxx-0002-96-R00.pdf.
The Federal Institute of Industrial Property; Office Action of RU App. No. 2016109329/03; dated Jul. 10, 2019; 7 pages. (English translation 5 pages).
United States Patent and Trademark Office, Office Action of U.S. Appl. No. 15/068,786, dated Mar. 27, 2017, 9 pgs.
United States Patent and Trademark Office, Office Action of U.S. Appl. No. 15/612,953, dated Feb. 14, 2018, 10 pgs.
United States Patent and Trademark Office, Office Action of U.S. Appl. No. 16/056,944, dated Mar. 18, 2019, 12pgs.
United States Patent and Trademark Office, Office Action of U.S. Appl. No. 16/156,339, dated Dec. 13, 2018, 8 pgs.
United States Patent and Trademark Office, Office Action of U.S. Appl. No. 16/423,789, dated Feb. 18, 2020, 14 pgs.
United States Patent and Trademark Office; Final Office Action of U.S. Appl. No. 16/540,484; dated Mar. 30, 2020; 12 pgs.

* cited by examiner

FIG. 4
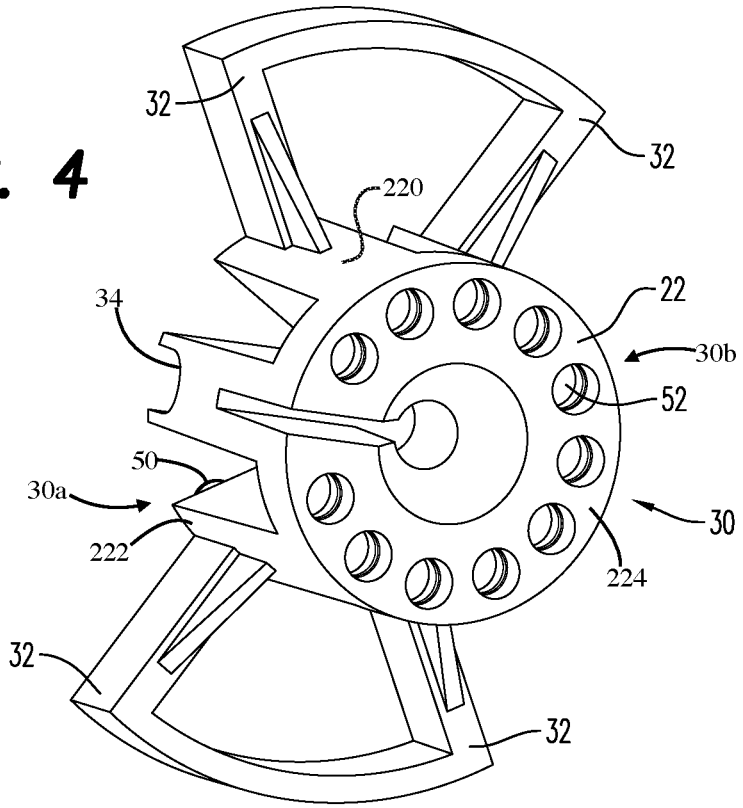
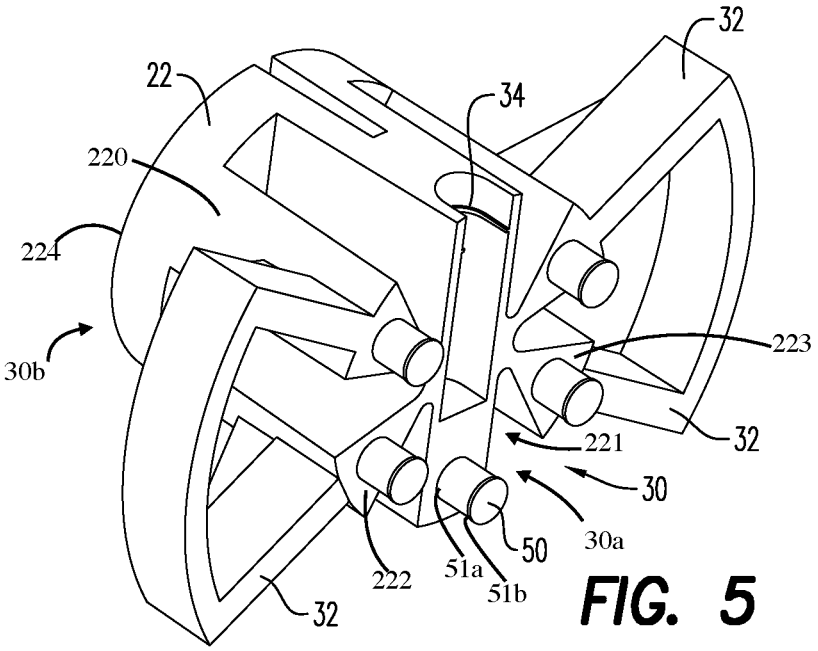
FIG. 5

FIG. 29
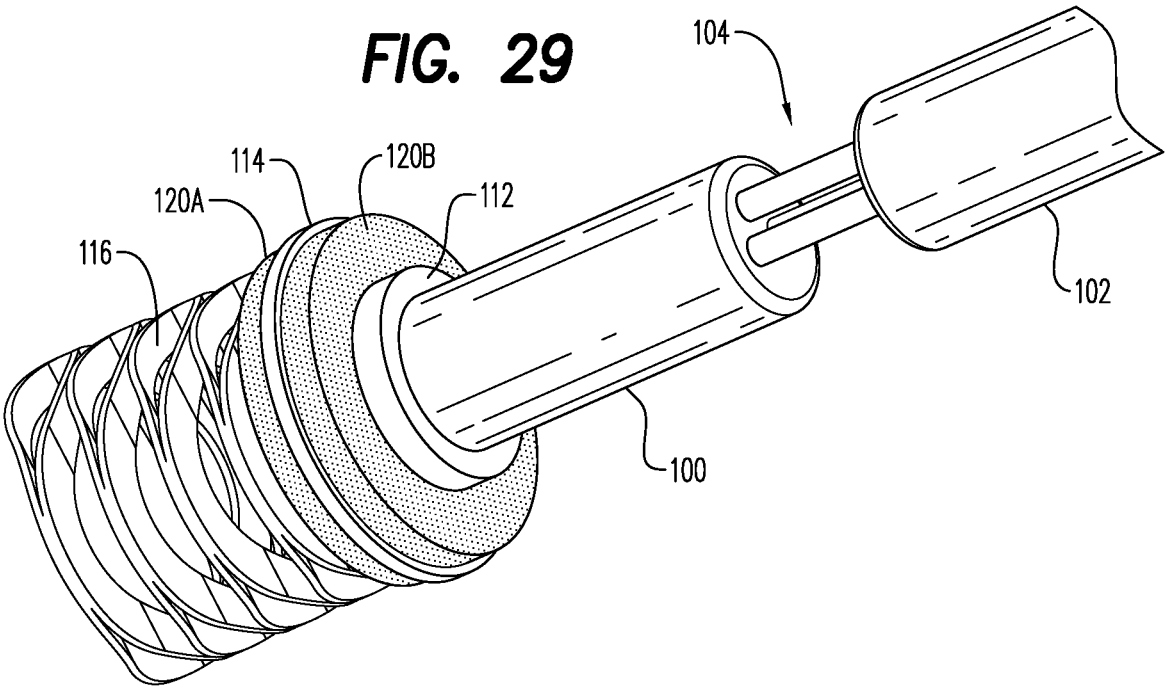
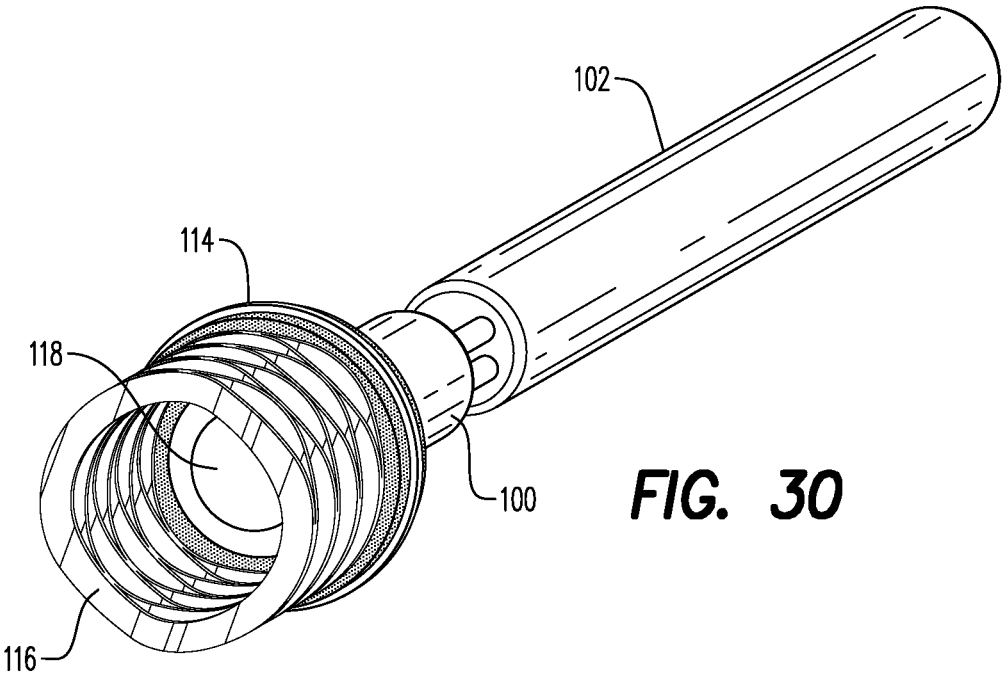
FIG. 30

PERFORATION GUN COMPONENTS AND SYSTEM

CROSS-REFERENCE TO RELATED APPLICATIONS

This application is a continuation of U.S. patent application Ser. No. 16/359,540 filed Mar. 20, 2019, which is a continuation of U.S. patent application Ser. No. 15/920,812 filed Mar. 14, 2018, which is a continuation of U.S. patent application Ser. No. 15/617,344 filed Jun. 8, 2017, which is a divisional patent application of U.S. patent application Ser. No. 15/287,309 filed Oct. 6, 2016, which is a divisional patent application of U.S. patent application Ser. No. 14/904,788 filed Jan. 13, 2016, which claims priority to PCT Application No. PCT/CA2014/050673 filed Jul. 16, 2014, which claims priority to Canadian Patent Application No. 2,821,506 filed Jul. 18, 2013, each of which is incorporated herein by reference in its entirety.

FIELD

A perforation gun system is generally described. More particularly, various perforation gun components that can be modularly assembled into a perforation gun system, the assembled perforated gun system itself, a perforation gun system kit, and a method for assembling a perforation gun system are generally described.

BACKGROUND

Perforation gun systems are used in well bore perforating in the oil and natural gas industries to tie a bore hole with a storage horizon within which a storage reservoir of oil or natural gas is located.

A typical perforation gun system consists of an outer gun carrier, arranged in the interior of which there are perforators-usually hollow or projectile charges-that shoot radially outwards through the gun carrier after detonation. Penetration holes remain in the gun carrier after the shot.

In order to initiate the perforators, there is a detonating cord leading through the gun carrier that is coupled to a detonator.

Different perforating scenarios often require different phasing and density of charges or gun lengths. Moreover, it is sometimes desirable that the perforators shooting radially outwards from the gun carrier be oriented in different directions along the length of the barrel. Therefore, phasing may be required between different guns along the length.

Onsite assembly of perforation gun systems may also be problematic under certain conditions as there are certain safety hazards inherent to the assembly of perforation guns due to the explosive nature of certain of its sub-components, including the detonator and the detonating cord.

There is thus a need for a perforation gun system, which by virtue of its design and components would be able to address at least one of the above-mentioned needs, or overcome or at least minimize at least one of the above-mentioned drawbacks.

SUMMARY

According to an embodiment, an object is to provide a perforation gun system that addresses at least one of the above-mentioned needs.

According to an embodiment, there is provided a perforation gun system having an outer gun carrier and comprising:

a top connector;

at least one stackable charge holder for centralizing a single shaped charge within the gun carrier;

a detonation cord connected to the top connector and to each stackable charge holder;

at least one bottom connector for terminating the detonation cord in the gun system; and a detonator energetically coupled to the detonation cord, wherein each of the top connector, at least one stackable charge holder and at least one bottom connector comprise a rotation coupling for providing a selectable clocking rotation between each of the top connector, at least one stackable charge holder and at least one bottom connector.

In some embodiments, the bottom connector may double as a spacer for spacing a plurality of stackable charge holders, and may either act as a metric dimensioned spacer or as an imperial dimensioned spacer for any specific metric or imperial shot density, phase and length gun system.

According to another aspect, there is also provided a perforation gun system kit having component parts capable of being assembled within an outer gun carrier, the kit comprising a combination of:

a top connector;

at least one stackable charge holder for centralizing a single shaped charge within the gun carrier;

a detonation cord connectable to the top connector and to each stackable charge holder;

at least one bottom connector adapted for terminating the detonation cord in the gun system; and a detonator energetically couplable to the detonation cord, wherein each of the top connector, at least one stackable charge holder and at least one bottom connector comprise a coupling having a plurality of rotational degrees of freedom for providing a selectable rotation between each of the top connector, at least one stackable charge holder and at least one bottom connector.

According to another aspect, there is also provided a method for assembling a perforation gun system, comprising the steps of:

providing a perforation gun system kit having component parts capable of being assembled within an outer gun carrier, the kit comprising a combination of:

a top connector;

at least one stackable charge holder for centralizing a single shaped charge within the gun carrier;

a detonation cord connectable to the top connector and to each stackable charge holder;

at least one bottom connector adapted for terminating the detonation cord in the gun system and adapted for doubling as a spacer for spacing a plurality of stackable charge holders; and a detonator energetically couplable to the detonation cord, wherein each of the top connector, at least one stackable charge holder and at least one bottom connector comprise a coupling having a plurality of rotational degrees of freedom for providing a selectable rotation between each of the top connector, at least one stackable charge holder and at least one bottom connector;

assembling a plurality of the stackable charge holders in a predetermined phase to form a first gun assembly;

running the detonation cord into a bottommost bottom connector;

assembling the bottommost bottom connector onto the assembled plurality of stackable charge holders;

running a through wire between the bottommost bottom connector and the top connector, so that the wire goes from the top connector to the bottom connector;

clicking the detonation cord into recesses formed in capturing projections, the captured projections being provided in each of the charge holders;

running the detonation cord into the top connector;

cutting the detonator cord; and installing charges into each of the charge holders.

A number of optional steps that are detailed below may be added to the above-described steps of the method.

According to another aspect, there is also provided a top connector for a perforation gun system comprising:

- a coupler for providing energetic coupling between a detonator and a detonating cord;
- at least one directional locking fin for locking the top connector within a gun carrier;
- a rotation coupling for providing a selectable clocking rotation between the top connector, and a charge holder wherein the top connector is configured to receive electrical connections therethrough.

According to another aspect, there is also provided a stackable charge holder for a perforation gun system having an outer gun carrier, the charge holder comprising:

- a charge receiving structure for receiving a single shaped charge;
- a plurality of projections for centralizing the shaped charge within the gun carrier; and
- at least one rotation coupling for providing a selectable clocking rotation between the charge holder and an adjacent component in the perforation gun system;

wherein a pair of the plurality of projections is configured for capturing a detonation cord traversing the charge holder.

According to another aspect, there is also provided a bottom connector for a perforation gun system comprising:

- a terminating structure arranged for terminating a detonation cord in the gun system;
- a plurality of wings or fins for axially locking the bottom connector to a snap ring fixed in the carrier.
- a rotation coupling for providing a selectable clocking rotation between the bottom connector and a charge holder;

wherein the rotation coupling is arranged such that bottom connector doubles as a spacer for spacing a plurality of stackable charge holders.

BRIEF DESCRIPTION OF THE DRAWINGS

These and other objects and advantages will become apparent upon reading the detailed description and upon referring to specific embodiments thereof that are illustrated in the appended drawings. Understanding that these drawings depict only typical embodiments and are not therefore to be considered to be limiting of its scope, exemplary embodiments will be described and explained with additional specificity and detail through the use of the accompanying drawings in which:

FIG. 4 is a front perspective view of a bottom connector in accordance with an embodiment;

FIG. 5 is a rear perspective view of the bottom connector shown in FIG. 4;

FIG. 29 is another detailed perspective view of the detonator shown in FIG. 27;

FIG. 30 is another detailed perspective view of the detonator shown in FIG. 27;

DETAILED DESCRIPTION

In the following description and accompanying FIGS., the same numerical references refer to similar elements throughout the FIGS. and text. Furthermore, for the sake of simplicity and clarity, namely so as not to unduly burden the FIGS. with several reference numbers, only certain FIGS. have been provided with reference numbers, and components and features of the embodiments illustrated in other FIGS. can be easily inferred therefrom. The embodiments, geometrical configurations, and/or dimensions shown in the FIGS. are for exemplification purposes only. Various features, aspects and advantages of the embodiments will become more apparent from the following detailed description.

Moreover, although some of the embodiments were primarily designed for well bore perforating, for example, they may also be used in other perforating scenarios or in other fields, as apparent to a person skilled in the art. For this reason, expressions such as "gun system", etc., as used herein should not be taken as to be limiting, and includes all other kinds of materials, objects and/or purposes with which the various embodiments could be used and may be useful. Each example or embodiment are provided by way of explanation, and is not meant as a limitation and does not constitute a definition of all possible embodiments.

In addition, although some of the embodiments are illustrated in the accompanying drawings comprise various components and although the embodiment of the adjustment system as shown consists of certain geometrical configurations as explained and illustrated herein, not all of these components and geometries are essential and thus should not be taken in their restrictive sense, i.e. should not be taken as to limit the scope. It is to be understood, as also apparent to a person skilled in the art, that other suitable components and cooperations thereinbetween, as well as other suitable geometrical configurations may be used for the adjustment systems, and corresponding parts, according to various embodiments, as briefly explained and as can easily be inferred herefrom by a person skilled in the art, without departing from the scope.

Figure 1:
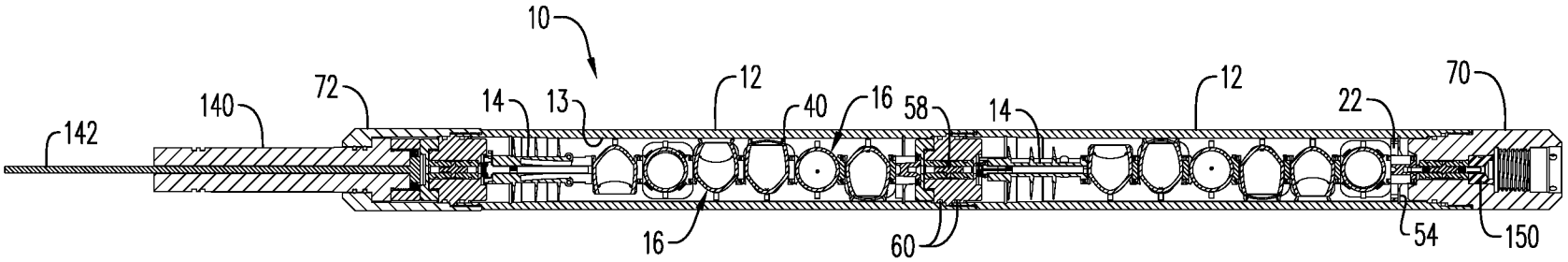
FIG. 1 is a side cut view of a perforation gun system according to an embodiment.
Figure 2:
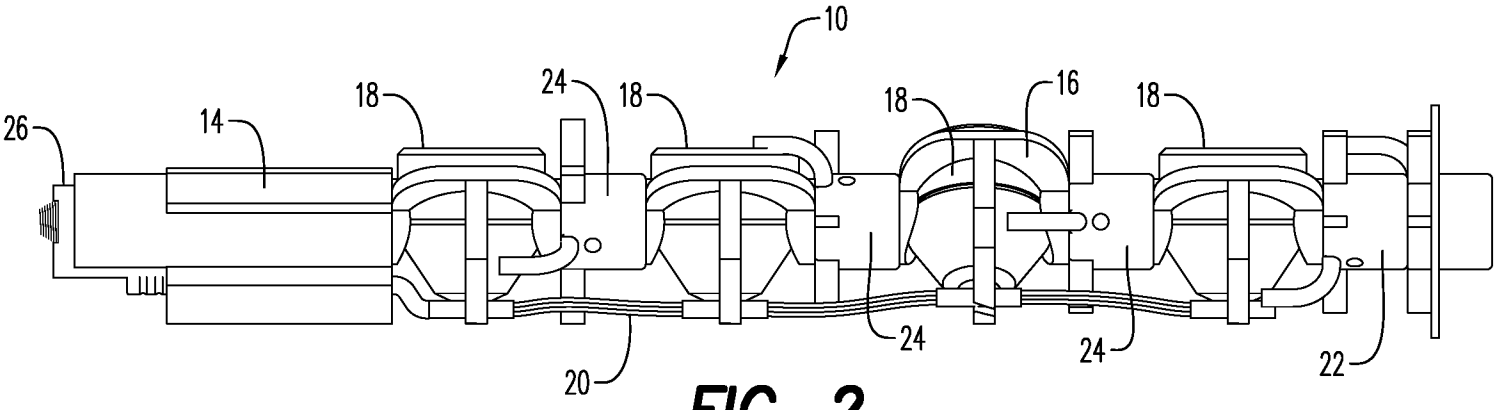
FIG. 2 is a side view of a top connector, bottom connector and stackable charge holders of a perforation gun system in accordance with another embodiment.
Figure 3:
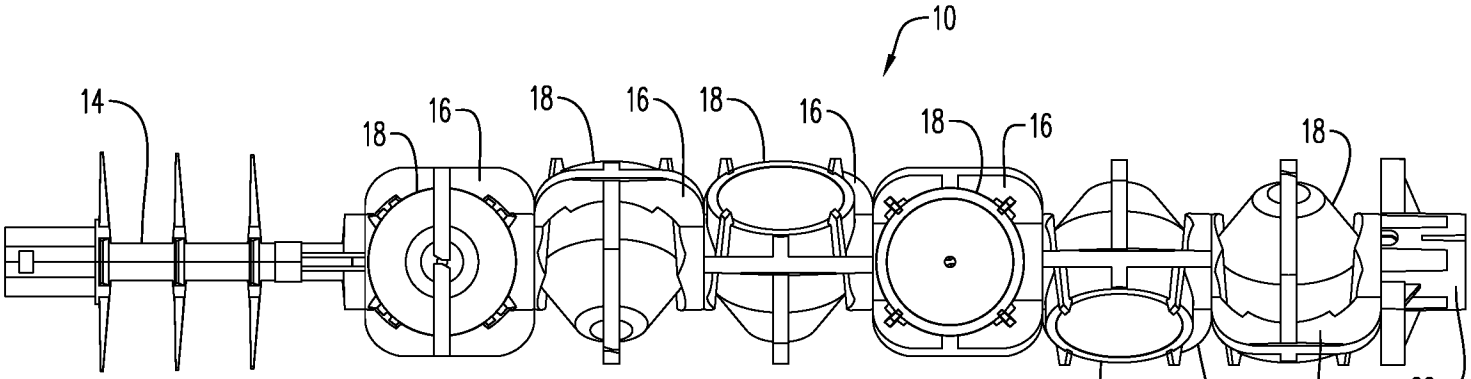
FIG. 3 is a side view of a top connector, bottom connector and stackable charge holders of a perforation gun system in accordance with another embodiment.
Figure 6:
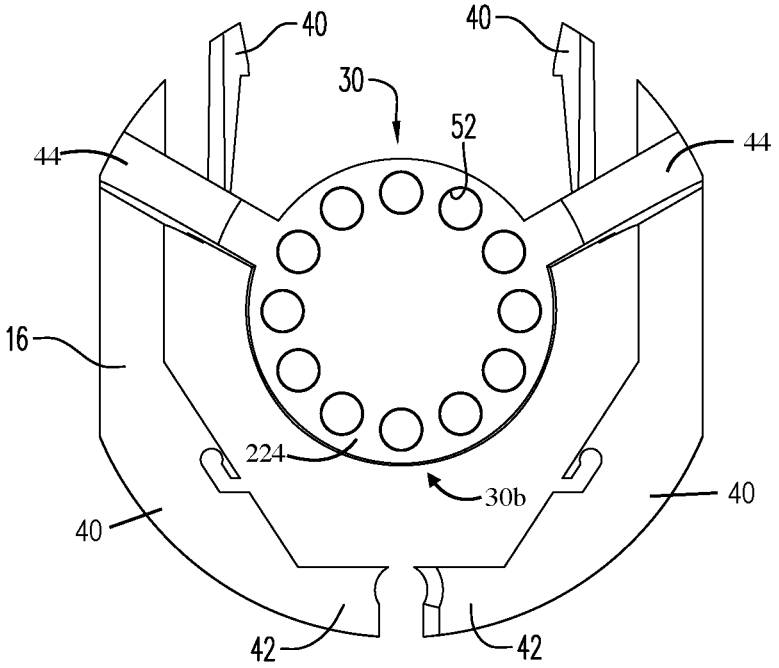
FIG. 6 is a front view of a stackable charge holder in accordance with an embodiment.
Figure 7:
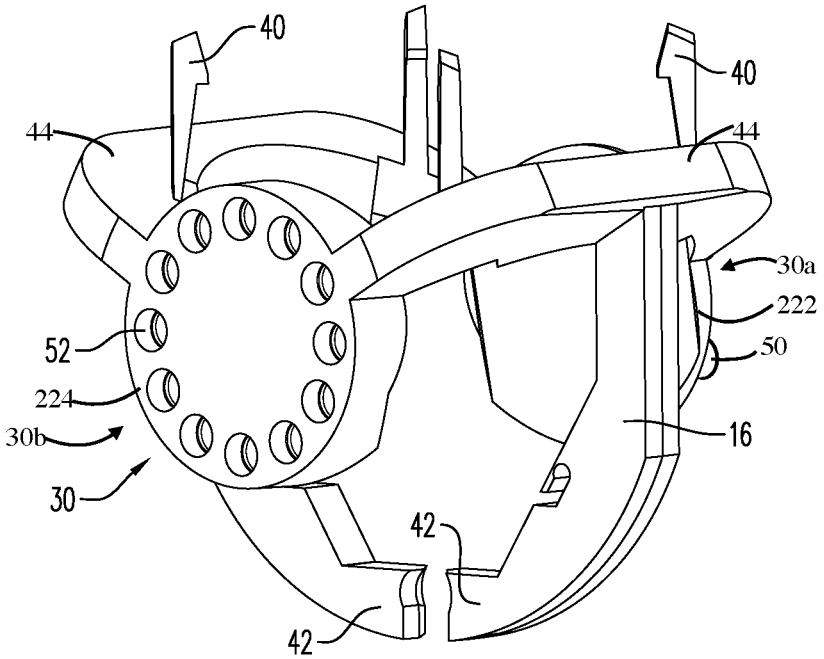
FIG. 7 is a front perspective view of the stackable charge holder shown in FIG. 6.
Figure 8:
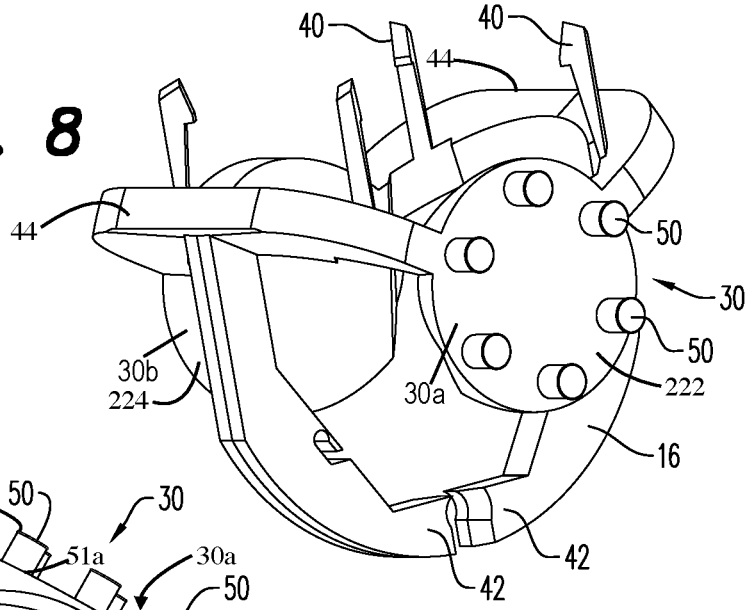
FIG. 8 is a rear perspective view of the stackable charge holder shown in FIG. 6.
Figure 9:
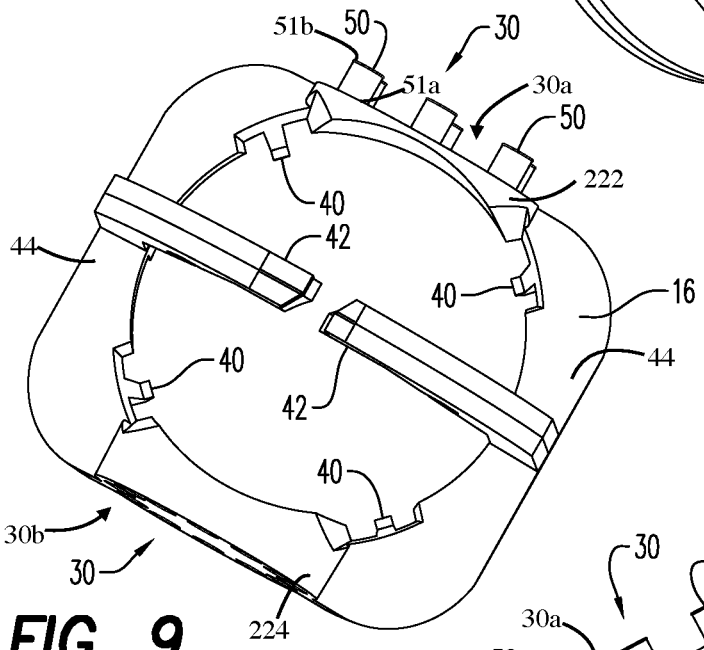
FIG. 9 is a bottom view of the stackable charge holder shown in FIG. 6.
Figure 10:
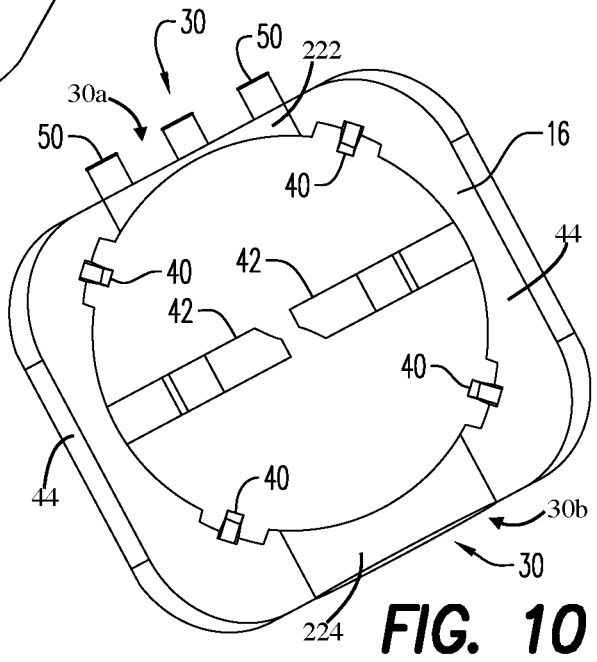
FIG. 10 is a top view of the stackable charge holder shown in FIG. 6.

Referring to FIGS. 1 to 3, an object is to provide a perforation gun system 10 having an outer gun carrier 12. The gun system 10 includes a top connector 14. At least one stackable charge holder 16 is provided for centralizing a single shaped charge 18 within the gun carrier 12. A detonation cord 20 is connected to the top connector 14 and to each stackable charge holder 16.

The gun system 10 includes at least one bottom connector 22 for terminating the detonation cord 20 in the gun system. As better shown in FIG. 2, it is also possible that the bottom connector 22 double as or serve the function of a spacer 24 for spacing a plurality of stackable charge holders 16.

In an embodiment, the gun system also includes a detonator 26 energetically coupled to the detonation cord 20.

As better shown in FIGS. 4 to 18, each of the top connector 14, stackable charge holder 16 and bottom connector 22 includes a rotation coupling 30 for providing a selectable clocking rotation between each of the above-mentioned components. As seen, for instance, in FIGS. 4-5 and 7-9, the rotation coupling 30 includes a first rotation coupling 30*a* and a second rotation coupling 30*b*.

Hence, a user can build multiple configurations of gun systems using various combinations of basic components. A first of these basic components includes a top connector. Another basic component is a single charge holder that centralizes a single shaped charge. The holder is adapted to be stacked and configured into 0, 30, 60, up to 360 degrees or any other combination of these phases for any specified length. Another basic component is a bottom connector that terminates the detonation cord in the gun. The bottom connector may carry as well an electrical connection therethrough. The bottom connector may also double as an imperial measurement stackable spacer to provide any gun shot density up to, for example, 6 shots per foot. Alternately, another bottom connector may be provided or configured to double as a metric measurement stackable spacer to provide any gun shot density up to, for example, 20 shots per meter. Another basic component includes a push-in detonator that does not use wires to make necessary connections. The push-in detonator may uses spring-loaded connectors, thus replacing any required wires and crimping.

Therefore, within the self-centralizing charge holder system, any number of spacers can be used with any number of holders for any specific metric or imperial shot density, phase and length gun system.

In an embodiment, only two pipe wrenches are required for assembly on site of the gun system, as no other tools are required.

In an embodiment, the top connector 14 provides energetic coupling between the detonator and detonating cord.

In an embodiment, each of the top connector 14, stackable charge holder 16 and bottom connector 22 are configured to receive electrical connections therethrough.

In an embodiment, all connections are made by connectors, such as spring-loaded connectors, instead of wires, with the exception of the through wire that goes from the top connector 14 to the bottom connector 22, whose ends are connectors.

In an embodiment, components of the assembly may include molded parts, which may also be manufactured to house the wiring integrally, through, for instance, overmolding, to encase the wiring and all connectors within an injection molded part. For example, the charge holder 16 could be overmolded to include the through wire.

Figure 19:
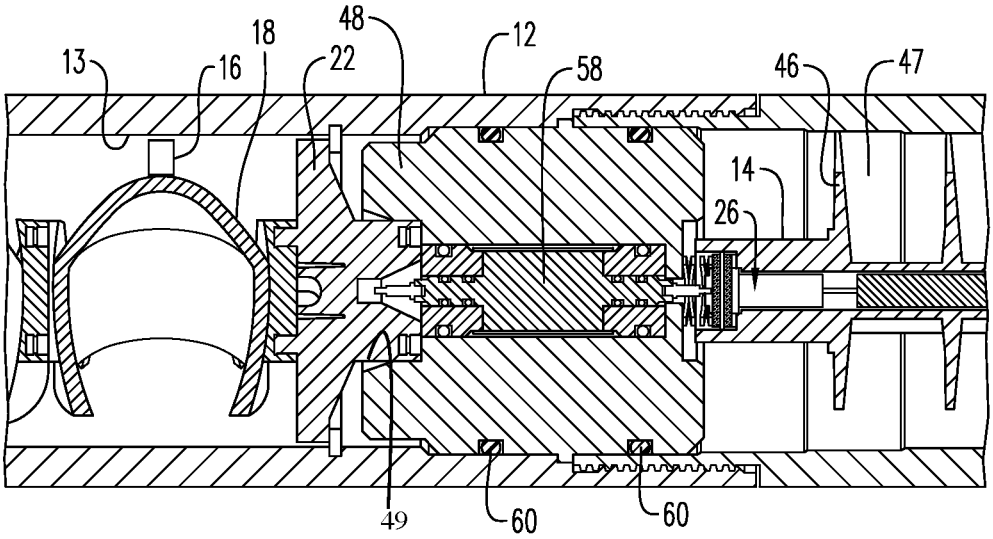
FIG. 19 is an enlarged detailed side cut view of a portion of the perforation gun system including a bulkhead and stackable charge holders shown in FIG. 1.

In an embodiment, and as shown in FIGS. 4 and 5, each bottom connector 22 includes a cylindrical body 220 comprising a first base 222 and a second base 224. The pins 50 outwardly extend from the first base 222, and the sockets 52 at least partially extend into the second base 224. As illustrated in FIGS. 4 and 5, each socket 52 is spaced apart from an adjacent socket and each pin 50 is spaced apart from an adjacent pin. The cylindrical body 220 may include a plurality of alternating v-shaped channels 221 and v-shaped walls 223. The v-shaped channels partially extend from the first base 222 towards the second base 224, and the v-shaped walls 223 extend from the second base 224 to the first base 222. At least one of the pins 50 of the rotation coupling 30 extend from one of the v-shaped walls 223. According to an aspect, when the bottom connector includes the first rotation coupling 30*a* and the second rotation coupling 30*b*, the cylindrical body 220 extends therebetween. The bottom connector 22 includes a plurality of fins/wings 32 radially extending from the body 220. The wings 32 are configured for axially locking each bottom connector against a snap ring 54, or an equivalent retainment mechanism to keep the charge holder 16 from sliding out of the bottom of carrier 12 as it is handled, (shown on FIG. 1). According to an aspect, and as illustrated in FIG. 19, the bottom connector 22 may be recessed into a recess 49 formed in the tandem seal adapter 48. The bottom connector 22 from a first gun assembly can accommodate or house an electrical connection through a bulkhead assembly 58 to the top connector 14 of a second or subsequent gun assembly, as seen for instance in FIG. 19. The top and bottom connector, as well as the spacer, in an embodiment, are made of 15% glass fiber reinforced, injection molding PA6 grade material, commercially available from BASF under its ULTRAMID® brand, and can provide a positive snap connection for any configuration or reconfiguration. As better shown in FIG. 5, a terminating means structure 34 is provided to facilitate terminating of the detonation cord. The structure 34 may be formed in the first base 222. The snap ring 54 is preinstalled on the bottom of the carrier 12. The assembly can thus shoulder up to the snap ring 54 via the bottom connector fins 32.

In an embodiment and as shown in FIGS. 6 to 10, each stackable charge holder 16 includes a charge receiving structure for receiving a single shaped charge, and a plurality of projections 40 extending from the charge receiving structure. The projections 40 may rest against an inner surface 13 or diameter of the gun carrier 12 (as shown in FIG. 1) and thereby centralizing the shaped charge therewithin. The charge receiving structure may include a pair of arms 44, and each projection 40 may extend from at least one of the arms 44. A pair 42 of the plurality of projections 40 may also be configured for capturing the detonation cord (not shown) traversing each stackable charge holder 16. The pair 42 of the plurality of projections are also used for centralizing the shaped charge within an inner surface of the gun carrier. According to an aspect, the stackable charge holder 15 includes a first base 222 and a second base 224 spaced apart from the first base 222. The arms 44 extend between the first and second bases 222, 224. According to an aspect, the pins 50 outwardly extend from the first base 222, and the sockets 52 at least partially extend into the second base 224. Each pin is spaced apart from an adjacent pin, and each socket 52 is spaced apart from an adjacent socket.

Figure 11:
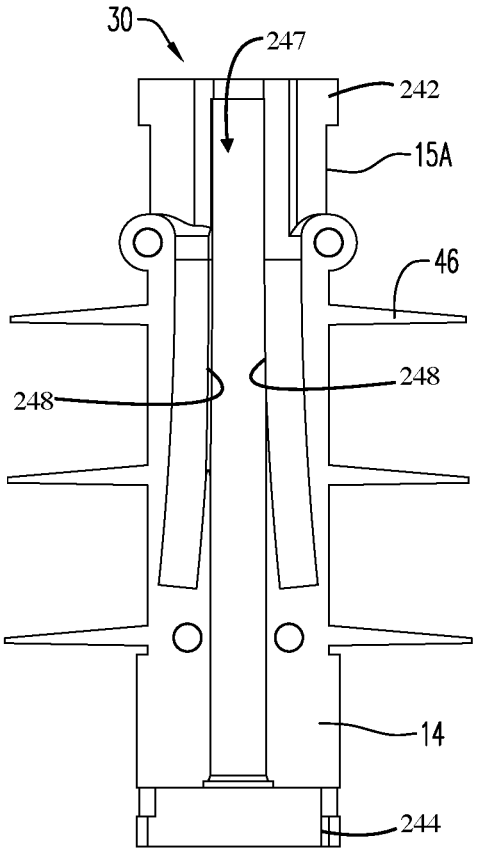
FIG. 11 is a bottom view of a half-portion of a top connector in accordance with an embodiment.
Figure 12:
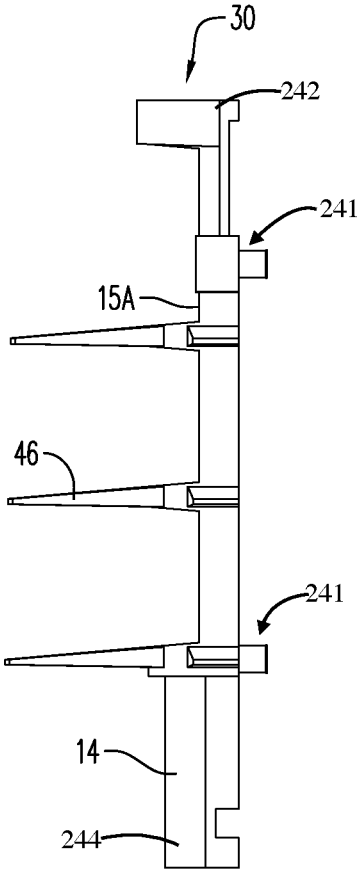
FIG. 12 is a side view of the half-portion of the top connector shown in FIG. 11.
Figure 13:
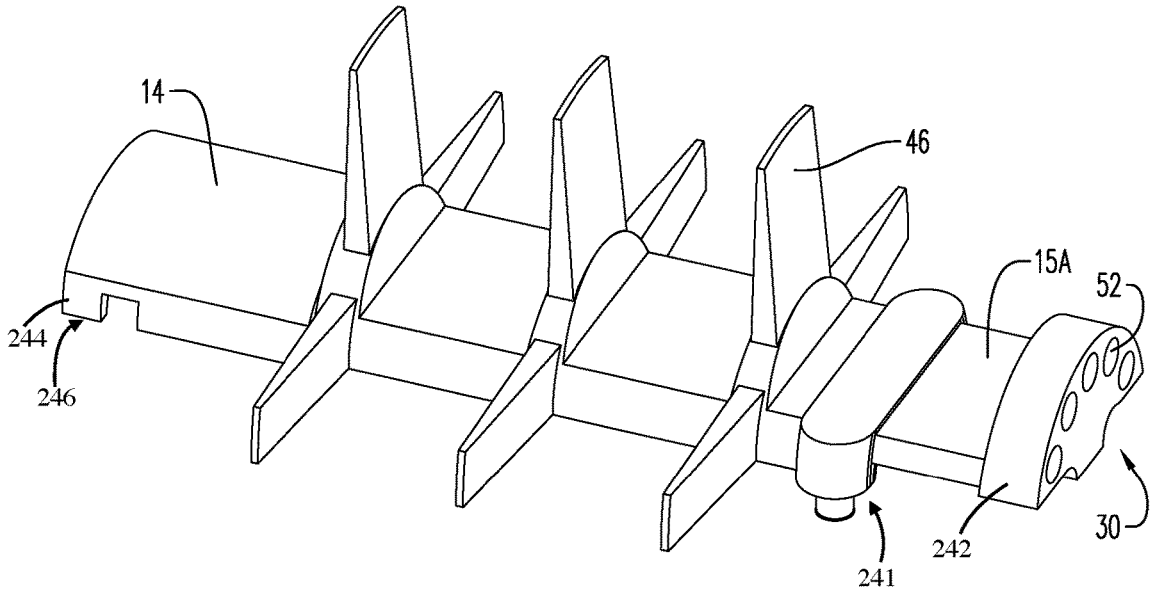
FIG. 13 is a top perspective view of the half-portion of the top connector shown in FIG. 11.
Figure 14:
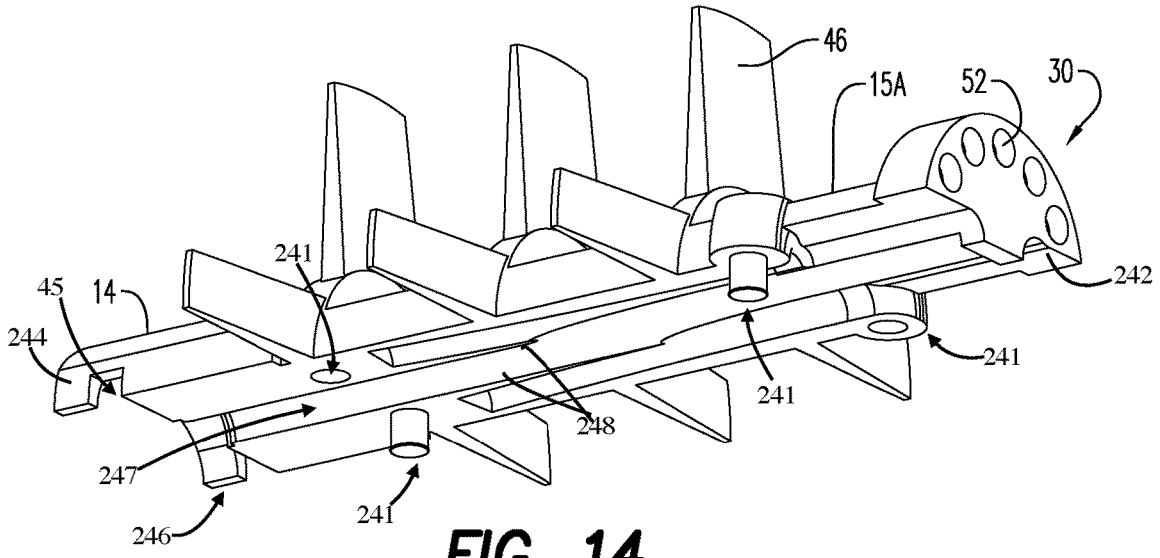
FIG. 14 is a bottom perspective view of the half-portion of the top connector shown in FIG. 11.
Figure 15:
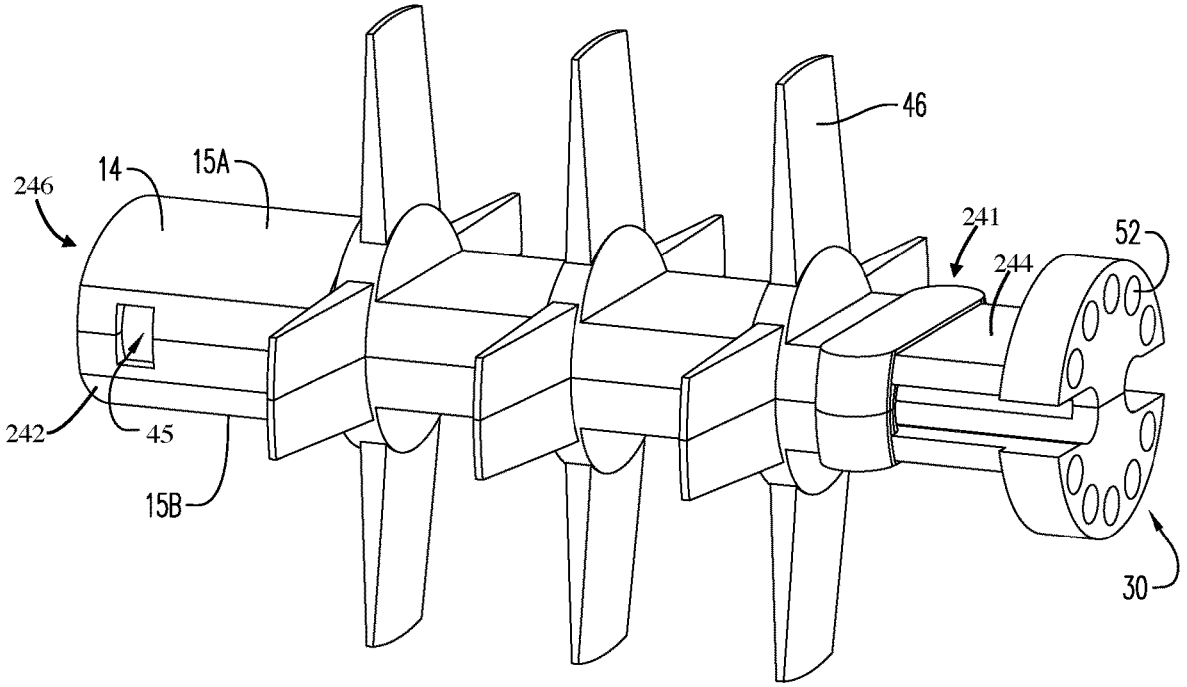
FIG. 15 is a perspective view of a top connector in accordance with an embodiment.
Figure 16:
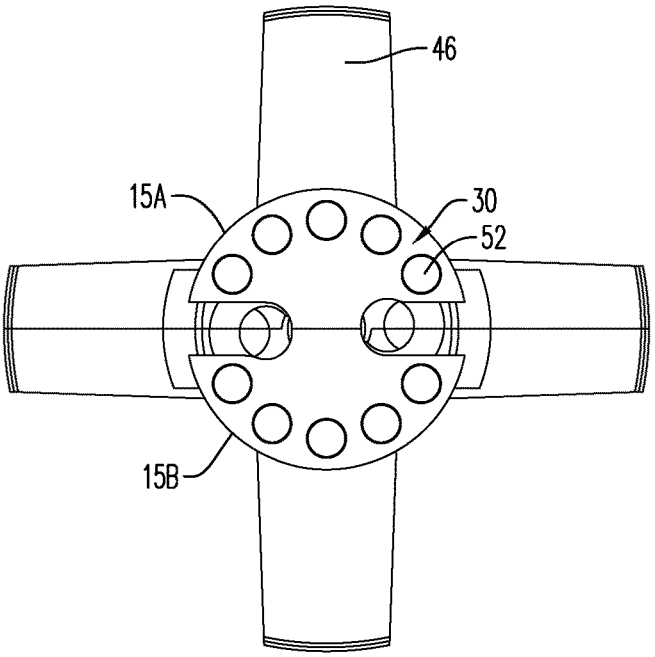
FIG. 16 is a front end view of the top connector shown in FIG. 15.
Figure 17:
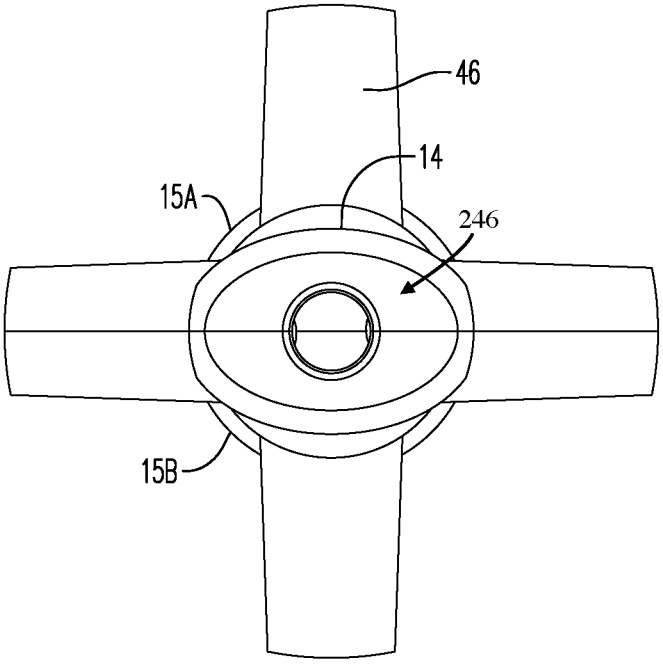
FIG. 17 is a rear end view of the top connector shown in FIG. 15.
Figure 18:
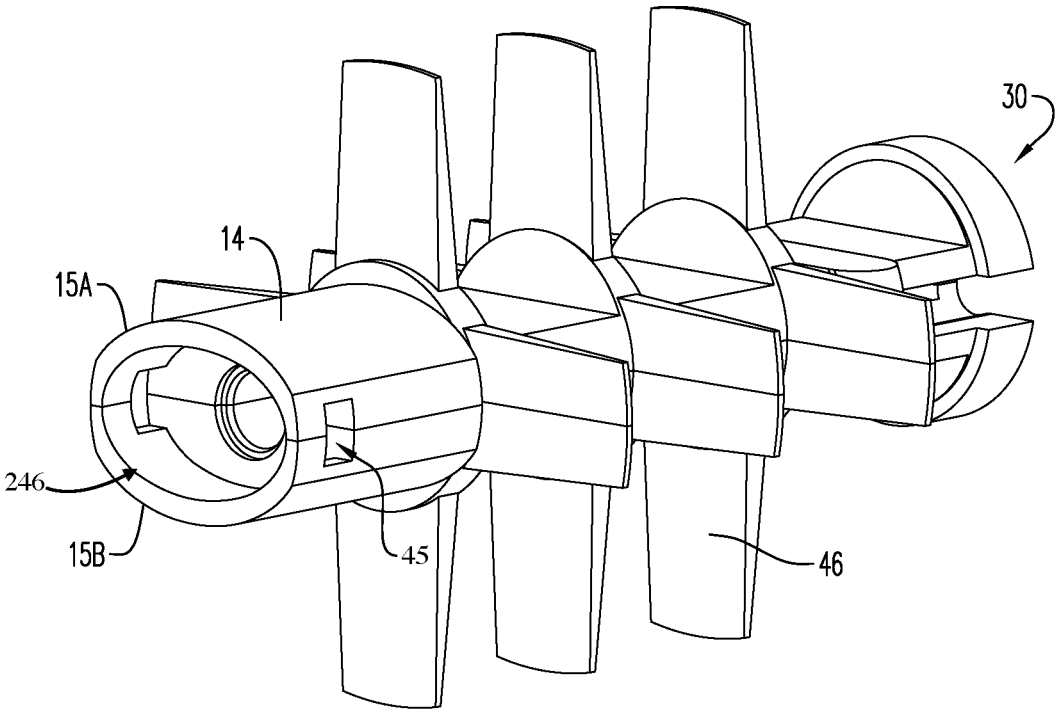
FIG. 18 is a rear perspective view of the top connector shown in FIG. 15.

In an embodiment, as shown in FIGS. 11 to 18, the top connector 14 includes a first end 242, a second end 244, and a coupler 246 formed at the first end 242. The top connector 14 may be configured for providing energetic coupling between the detonator 26 and a detonation cord. According to an aspect and as illustrated in FIGS. 11 and 14, an elongated opening 247 extends from the second end 244, adjacent the coupler 246, towards the first end 242. The elongated opening 247 is flanked by side walls 248 that provide the energetic coupling between the detonator 26 and the detonation cord 20. A rotation coupling 30 is formed at the second end 244. The rotation coupling includes at least one of a plurality of pins 50 and a plurality of sockets 52. According to an aspect, the top connector 14 includes at least one directional locking fin 46. Although the use of directional locking fins is described, other methods of directional locking may be used, in order to eliminate a top snap ring that would otherwise be used to lock the assembly. As better shown in FIG. 19, the locking fins 46 are engageable with corresponding complementarily-shaped structures 47 housed within the carrier 12, upon a rotation of the top connector 14, to lock the position of the top connector along the length of the carrier 12.

In an embodiment, as better shown in FIG. 19, the bottom connector 22 on one end and the top connector 14 on the other end abuts/connects to the bulkhead assembly 58. The tandem seal adapter 48 is configured to seal the inner components within the carrier 12 from the outside environment, using sealing means 60 (shown herein as o-rings). Thus, the tandem seal adapter 48 seals the gun assemblies from each other along with the bulkhead 58, and transmits a ground wire to the carrier 12. Hence, the top connector 14 and bulkhead 58 accommodate electrical and ballistic transfer to the charges of the next gun assembly for as many gun assembly units as required, each gun assembly unit having all the components of a gun assembly.

In an embodiment, the tandem seal adapter 48 is a two-part tandem seal adapter (not shown) that fully contains the bulkhead assembly 58 (comprised of multiple small parts as shown, for instance, in FIG. 19) and that is reversible such that it has no direction of installation.

In an embodiment and as better shown in FIGS. 27-31 and 35A, the detonator assembly 26 includes a detonator head 100, a detonator body 102 and a plurality of detonator wires 104, including a through wire 106, a signal-in wire 108 and a ground wire 110. The through wire 106 traverses from the top to the bottom of the perforating gun system 10, making a connection at each charge holder 16. The detonator head 100 further includes a through wire connector element 112 connected to the through wire 106 (not shown), a ground contact element 114 for connecting the ground wire 110 to the tandem seal adapter (also not shown), through ground springs 116, and a bulkhead connector element 118 for connecting the signal-in wire 108 to the bulkhead assembly 58 (also not shown). Different insulating elements 120A, 120B are also provided in the detonator head 100 for the purpose of insulating the detonator head 100 and detonator wires 104 from surrounding components. As better shown in FIG. 31, a crimp sleeve 122 can be provided to cover the detonator head 100 and body 102, thus resulting in a more robust assembly. The above configuration allows the detonator to be installed with minimal tooling and wire connections.

Figure 32:
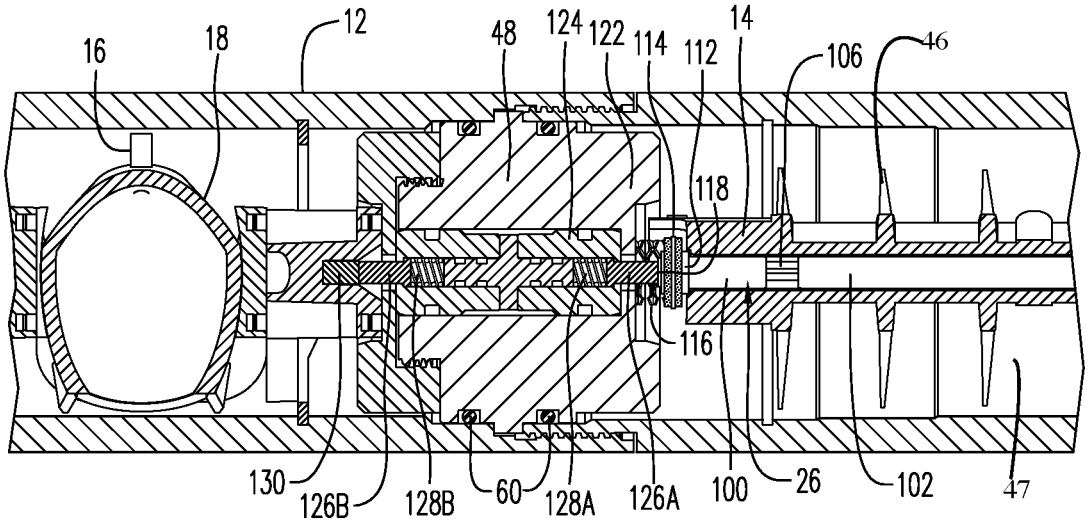
FIG. 32 is a detailed side view of a tandem seal adapter and detonator in accordance with another embodiment.
Figure 33:
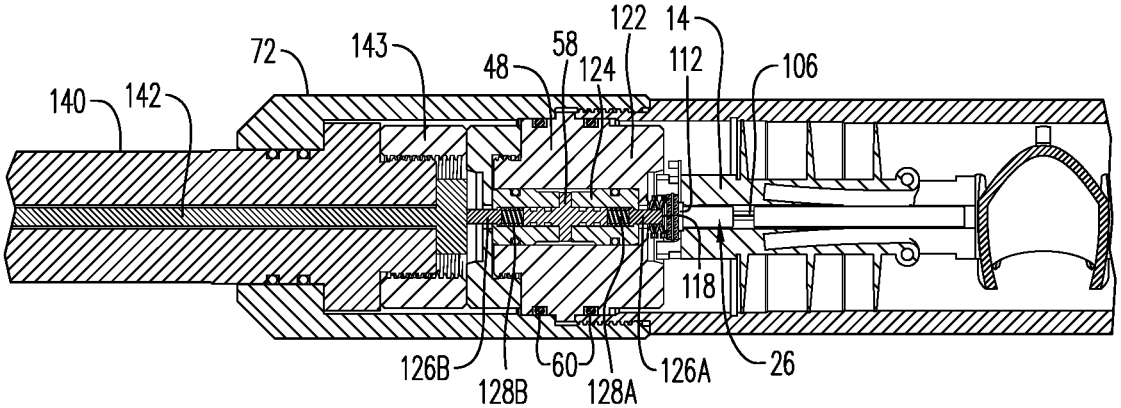
FIG. 33 is a side cut view of a portion of a perforation gun system illustrating the configuration of the top sub in accordance with another embodiment.
Figure 35A:
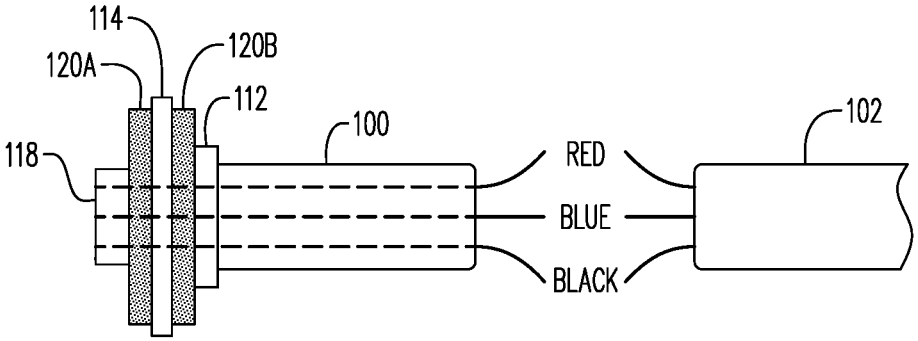
FIGS. 35A and 35B are electrical schematic views of a detonator and of wiring within a perforated gun system in accordance with another embodiment.
Figure 35B:
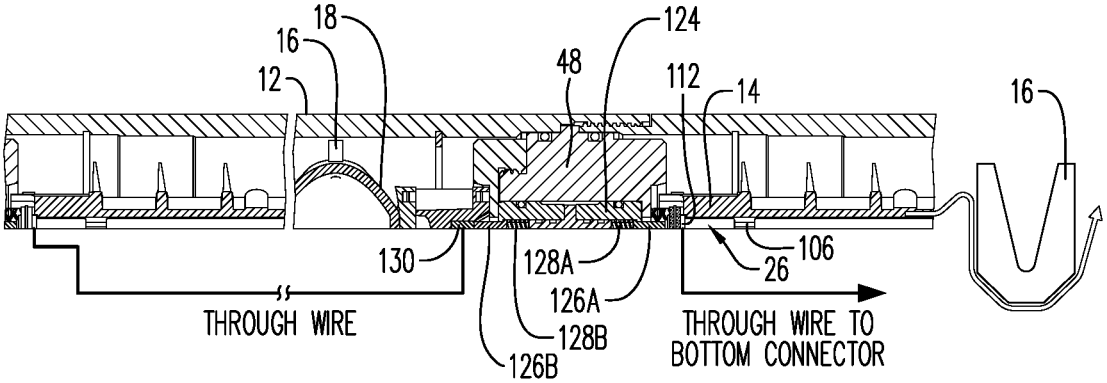

In an embodiment as shown in FIGS. 32, 33 and 35B illustrate a connection of the above-described detonator assembly 26 to the tandem seal adapter 48 and a pressure bulkhead 124. The bulkhead 124 includes spring connector end interfaces comprising contact pins 126A, 126B, linked to coil springs 128A, 128B. This dual spring pin connector assembly including the bulkhead 124 and coil springs 128A, 128B is positioned within the tandem seal adapter 48 extending from a conductor slug 130 to the bulkhead connector element. The dual spring pin connector assembly is connected to the through wire 106 of the detonator assembly 26.

In an embodiment and as better shown in FIGS. 11 to 18, the top connector 14 may have a split design to simplify manufacturing and aid in assembly. By "split design" what is meant is that the top connector 14 can be formed of two halves—a top half 15A and a bottom half 15B. A plurality of securing mechanisms 241 may be provided to couple the top half 15A to the bottom half 15B. As better shown in FIG. 15 or 18, the top connector 14 may also include a blind hole 45 to contain or house the detonation cord, thus eliminating the need for crimping the detonation cord during assembly.

In an embodiment and as shown for example in FIGS. 4 to 18, the rotation coupling 30 may either include a plurality of pins 50 (FIG. 5) symmetrically arranged about a central axis of the rotation coupling 30, or a plurality of sockets 52 (FIG. 4) symmetrically arranged about the central axis of the rotation coupling 30 and configured to engage the plurality of pins 50 of an adjacent rotation coupling 30. The pins each include a first end 51*a*, and a second end 51*b* opposite the first end 51*a*. According to an aspect, the second end 51*b* is wider than the first end 51*a*.

In another embodiment, the rotation coupling 30 may either include a polygon-shaped protrusion, or a polygon-shaped recess configured to engage the polygon-shaped protrusion of an adjacent rotation coupling. The polygon can be 12-sided for example for 30 degree increments.

In another embodiment, the top and bottom subs work with off the shelf running/setting tools as would be understood by one of ordinary skill in the art.

In one embodiment and as shown in FIG. 33, the top sub 72 facilitates use of an off the shelf quick change assembly 140 to enable electrical signals from the surface, as well as to adapt perforating gun system to mechanically run with conventional downhole equipment. The quick change assembly 140 may include a threaded adapter 143 to set an offset distance between an electrical connector 142 and the contact pin 126B extending from the bulkhead assembly 58.

Figure 34:
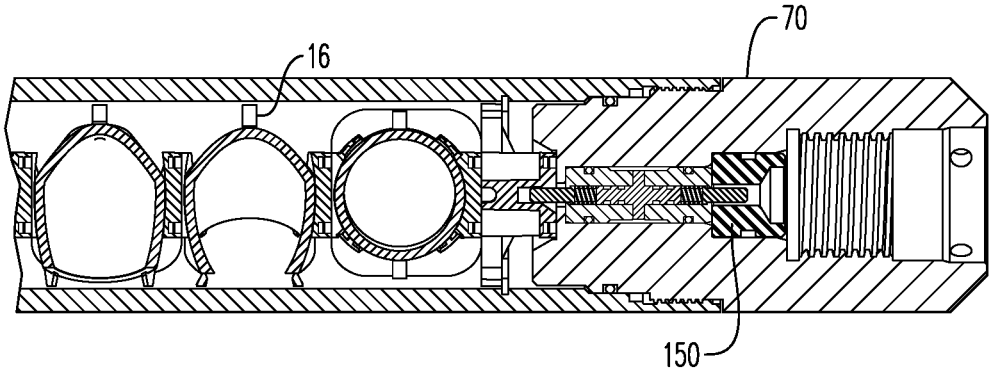
FIG. 34 is a side cut view of a portion of a perforation gun system illustrating the configuration of the bottom sub in accordance with another embodiment.

In one embodiment and as shown in FIG. 34, the bottom sub 70 may be configured as a sealing plug shoot adapter (SPSA) to be used specifically with this embodiment. The SPSA may receive an off the shelf quick change assembly 140 (not shown) and insulator 150 that communicates with a firing head threaded below it (not shown). A setting tool (not shown) may run on the bottom side of the perforating gun.

In an embodiment, final assembly of the tool string requires only two pipe wrenches. No tools are required to install the detonator or any electrical connections.

An object is to also provide a perforation gun system kit having the basic component parts described above and capable of being assembled within an outer gun carrier.

Figure 21:
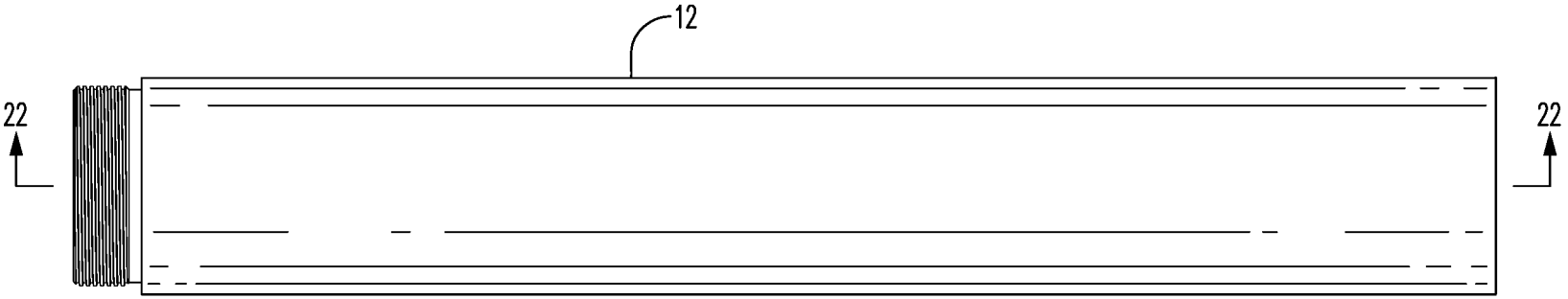
FIG. 21 is a side view of a gun carrier of a gun system in accordance with an embodiment.
Figure 22:
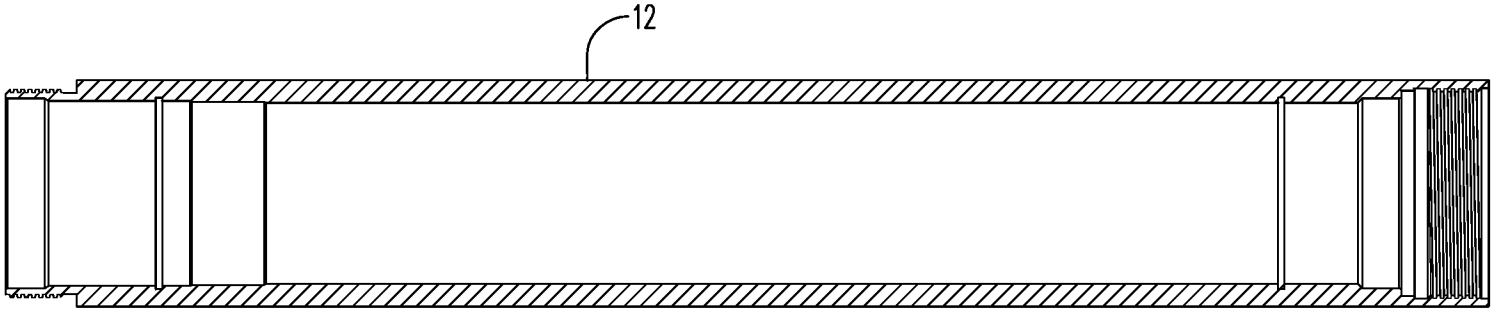
FIG. 22 is a side cut view of the gun carrier shown in FIG. 21.

In an embodiment, a method for assembling a perforation gun system is provided, to which a certain number of optional steps may be provided. The steps for assembling the gun system for transport include the steps of:

providing a perforation gun system kit having component parts capable of being assembled within an outer gun carrier (element 12 in FIGS. 1, 21 and 22), the kit comprising a combination of:

a top connector;

at least one stackable charge holder for centralizing a single shaped charge within the gun carrier;

a detonation cord connectable to the top connector and to each stackable charge holder;

at least one bottom connector adapted for terminating the detonation cord in the gun system and adapted for doubling as a spacer for spacing a plurality of stackable charge holders; and a detonator energetically couplable to the detonation cord, wherein each of the top connector, at least one stackable charge holder and at least one bottom connector comprise a coupling having a plurality of rotational degrees of freedom for providing a selectable rotation between each of the top connector, at least one stackable charge holder and at least one bottom connector;

assembling a plurality of the stackable charge holders in a predetermined phase to form a first gun assembly;

running the detonation cord into a bottommost bottom connector;

assembling the bottommost bottom connector onto the assembled plurality of stackable charge holders;

running a through wire between the bottommost bottom connector and the top connector, so that the through wire goes from the top connector to the bottom connector;

clicking the detonation cord into recesses formed in capturing projections, the capturing projections being provided in each of the charge holders;

running the detonation cord into the top connector;

cutting the detonator cord, if the detonator cord is not precut a predetermined length; and installing charges into each of the charge holders.

In an embodiment, the method further includes, prior to transport, the steps of: pushing assembled components together to engage all pin connections therebetween; and carrying out a continuity test to ensure complete connectivity of the detonating chord.

Figure 20:
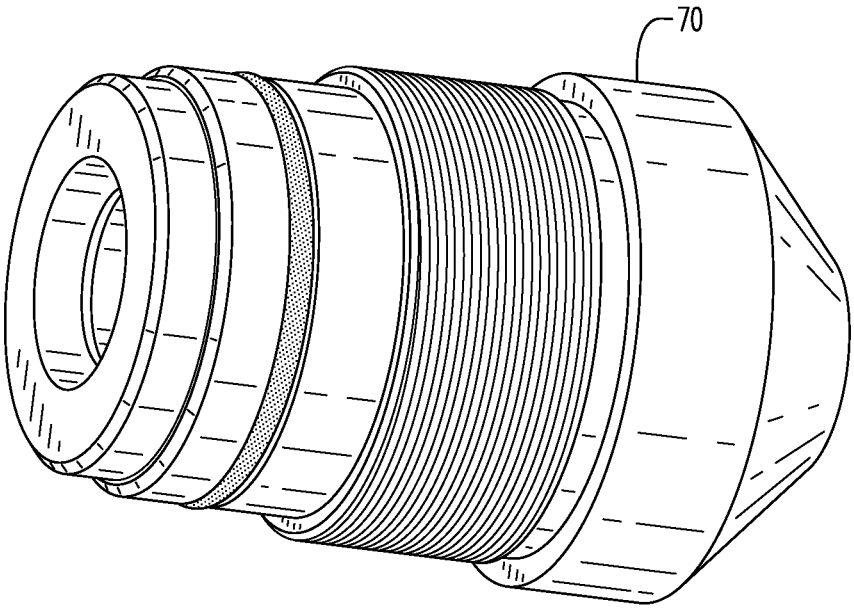
FIG. 20 is a perspective view of a bottom sub of a gun system in accordance with an embodiment.
Figure 23:
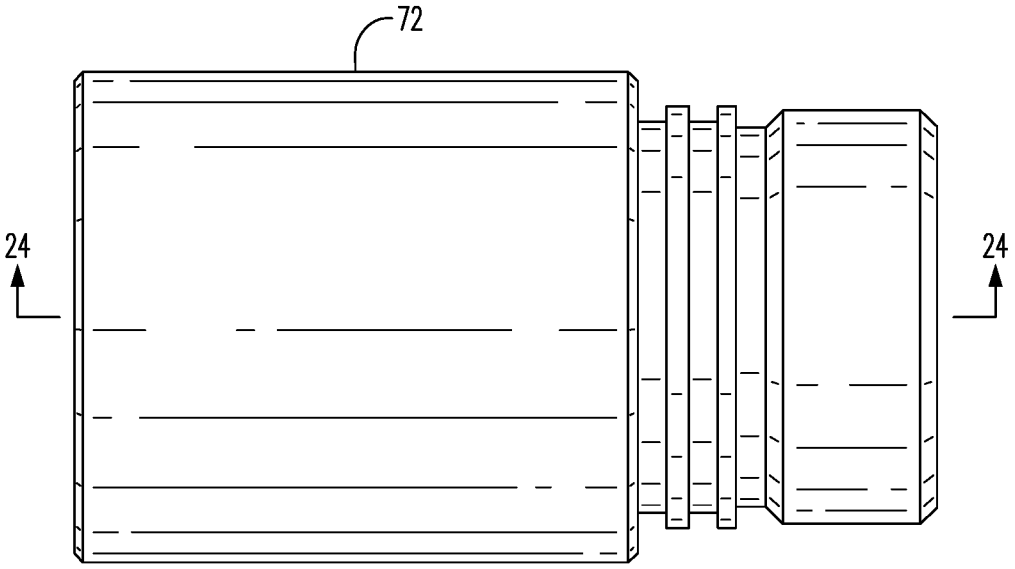
FIG. 23 is a side view of a top sub of a gun system in accordance with an embodiment.
Figure 24:
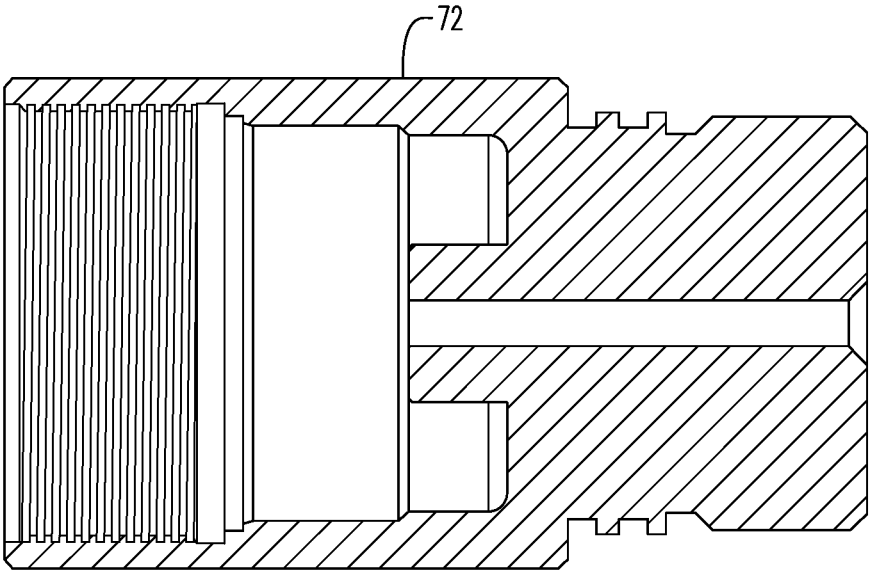
FIG. 24 is a side cut view of the top sub shown in FIG. 23.
Figure 25:
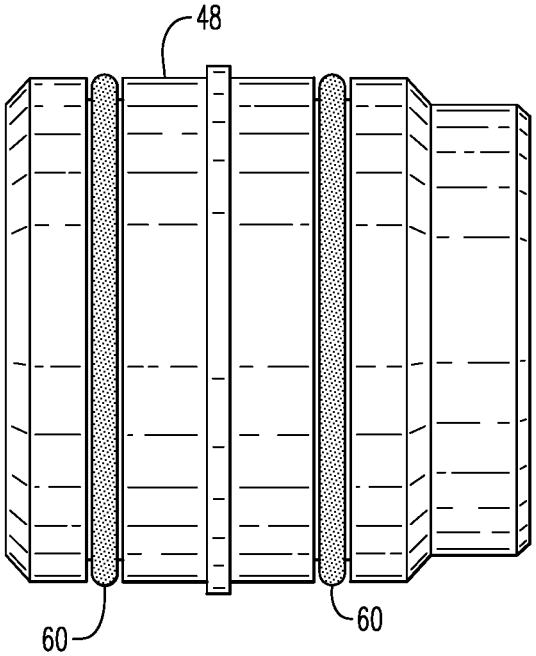
FIG. 25 is a side view of a tandem seal adapter of a gun system in accordance with an embodiment.
Figure 26:
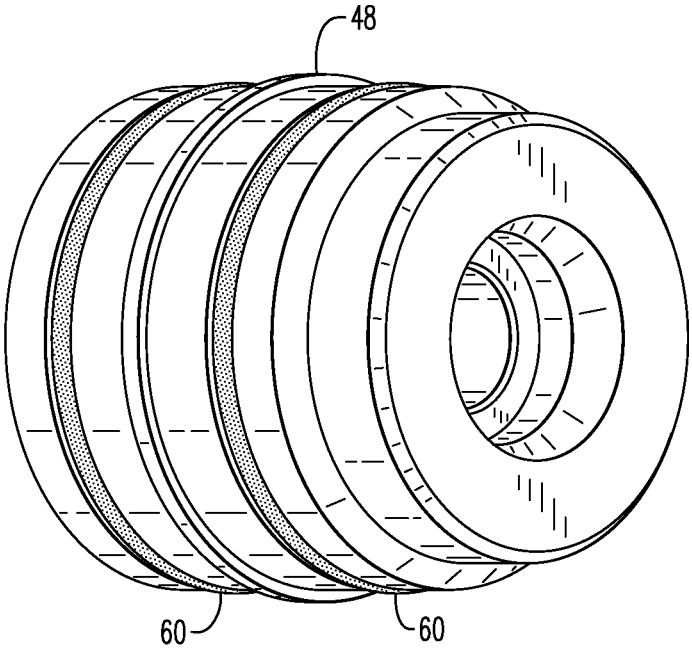
FIG. 26 is a perspective view of the tandem seal adapter shown in FIG. 25.
Figure 27:
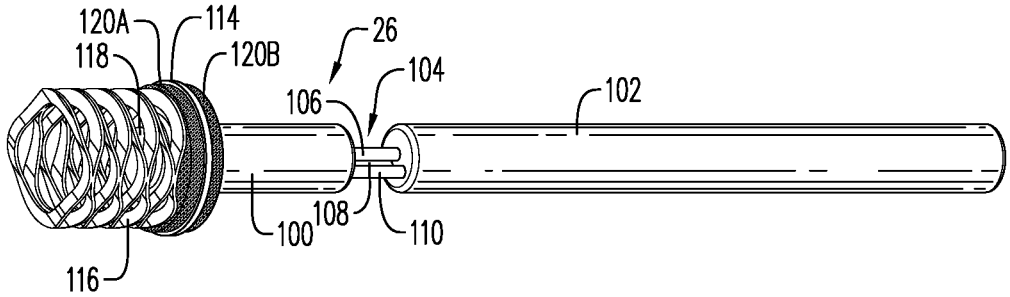
FIG. 27 is a perspective view of a detonator in accordance with an embodiment.
Figure 28:
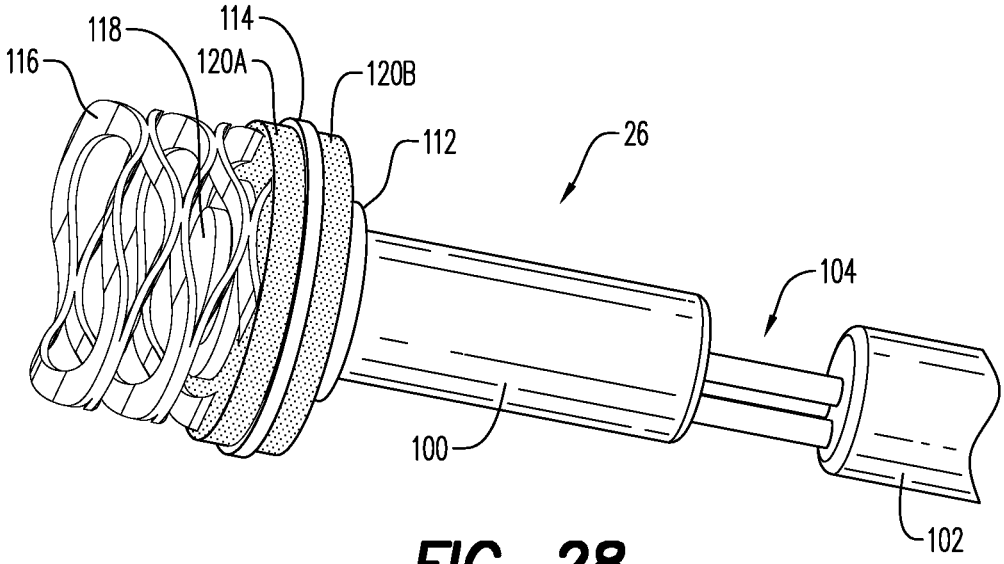
FIG. 28 is a detailed perspective view of the detonator shown in FIG. 27.
Figure 31:
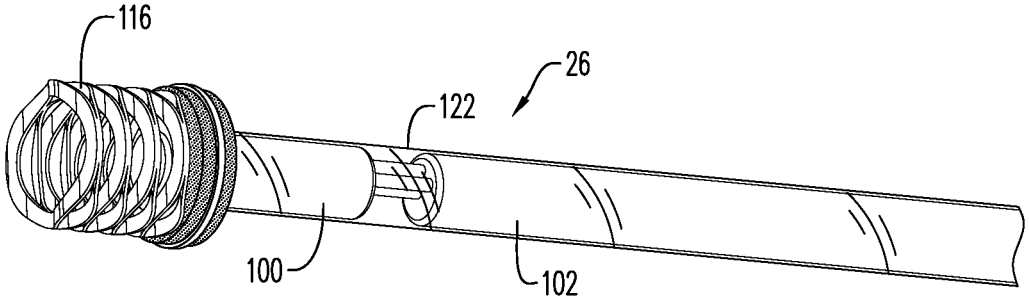
FIG. 31 is another detailed perspective view of the detonator shown in FIG. 27, with a crimp sleeve.

In an embodiment, on location, to complete the assembly, the method further comprises the steps of threading on the previously assembled components a bottom sub (element 70 on FIGS. 1 and 20);

installing and connecting the detonator;

pushing in a tandem seal adapter with o-rings onto the first gun assembly;

pushing in a bulkhead (element 58 in FIG. 19) onto the tandem seal adapter, if the bulkhead and the tandem seal adapter are not pre-assembled;

threading a subsequent gun assembly onto the first gun assembly or threading a top sub (element 72 in FIGS. 1, 23 and 24) onto a topmost assembled gun assembly, for connection to a quick change assembly.

Of course, the scope of the perforation gun system, various perforation gun components, the perforation gun system kit, and the method for assembling a perforation gun system should not be limited by the various embodiments set forth herein, but should be given the broadest interpretation consistent with the description as a whole. The components and methods described and illustrated are not limited to the specific embodiments described herein, but rather, features illustrated or described as part of one embodiment can be used on or in conjunction with other embodiments to yield yet a further embodiment. Further, steps described in the method may be utilized independently and separately from other steps described herein. Numerous modifications and variations could be made to the above-described embodiments without departing from the scope of the FIGS. and claims, as apparent to a person skilled in the art.

In this specification and the claims that follow, reference will be made to a number of terms that have the following meanings. The singular forms "a," "an" and "the" include plural referents unless the context clearly dictates otherwise. Further, reference to "top," "bottom," "front," "rear," and the like are made merely to differentiate parts and are not necessarily determinative of direction. Similarly, terms such as "first," "second," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of"

Advances in science and technology may make equivalents and substitutions possible that are not now contemplated by reason of the imprecision of language; these variations should be covered by the appended claims. This written description uses examples to disclose the perforation gun system, various perforation gun components, the perforation gun system kit, and the method for assembling a perforation gun system, including the best mode, and also to enable any person of ordinary skill in the art to practice same, including making and using any devices or systems and performing any incorporated methods. The patentable scope of the perforation gun system, various perforation gun components, the perforation gun system kit, and the method for assembling a perforation gun system is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. An electrical connection assembly for establishing an electrical connection in a tool string, the electrical connection assembly comprising:

a tandem seal adapter having a first end, a second end and a bore that extends from the first end to the second end and entirely through the tandem seal adapter;

a perforation gun system comprising a first outer gun carrier, a shaped charge, and a first detonator, wherein the shaped charge and the first detonator are positioned within the first outer gun carrier, wherein the first outer gun carrier is connected to the first end of the tandem seal adapter; and a pressure bulkhead having an outer surface, a first end and a second end, the outer surface of the pressure bulkhead is sealingly received in the bore of the tandem seal adapter, the pressure bulkhead also having a pin connector assembly extending through the pressure bulkhead from a first pin connector end to a second pin connector end, and configured to relay an electrical signal from the first end of the pressure bulkhead to the second end of the pressure bulkhead, wherein the first pin connector end extends beyond the first end of the pressure bulkhead and the second pin connector end extends beyond the second end of the pressure bulkhead, wherein the first detonator is in electrical communication with the pin connector assembly, wherein the tandem seal adapter and the pressure bulkhead are configured to provide a seal between the detonator and an environment on the second end of the tandem seal adapter.

2. The electrical connection assembly of claim 1, wherein it is not possible to interrupt the electrical signal from the first pin connector end to the second pin connector end.

3. The electrical connection assembly of claim 1, wherein the pin connector assembly further comprises:

a spring loaded contact pin.

4. The electrical connection assembly of claim 1, wherein the pin connector assembly further comprises:

a first spring loaded contact pin, wherein a portion of the first spring loaded contact pin extends from a body of the pressure bulkhead adjacent the first end of the tandem seal adapter.

5. The electrical connection assembly of claim 4, wherein the pin connector assembly further comprises:

a second spring loaded contact pin, wherein a portion of the second spring loaded contact pin extends from a body of the pressure bulkhead adjacent the second end of the tandem seal adapter.

6. The electrical connection assembly of claim 1, wherein the pin connector assembly comprises:

a first contact pin having a first radius and a first pin head portion, wherein the first pin head portion has a radius that is greater than the first radius; and a second contact pin having a second radius and a second pin head portion, wherein the second pin head portion has a radius that is greater than the second radius, wherein the first pin head portion and the second pin head portion are each positioned within the pressure bulkhead, and a biasing member is positioned within the pressure bulkhead and configured for exerting a force on the first pin head portion or the second pin head portion.

7. The electrical connection assembly of claim 1, wherein the pin connector assembly further comprises:

a first contact pin;

a second contact pin;

an inner body positioned between the first contact pin on one end and the second contact pin on an opposite end; and a first biasing member and a second biasing member positioned within the pressure bulkhead between the first contact pin on the one end and the second contact pin on the opposite end, each of the first biasing member and the second biasing member exerting a force on the inner body.

8. The electrical connection assembly of claim 1, further comprising a spring-loaded electrical connection positioned adjacent to the tandem seal adapter.

9. The electrical connection assembly of claim 1, further comprising a second outer gun carrier connected to the second end of the tandem seal adapter and a bulkhead connector element positioned within the second outer gun carrier, wherein the second pin connector end is in wireless electrical contact with the bulkhead connector element.

10. The electrical connection assembly of claim 9, wherein the bulkhead connector element is in electrical communication with a second detonator positioned within the second outer gun carrier.

11. The electrical connection assembly of claim 10, wherein the first detonator includes a through wire connector element and a ground connector element.

12. The electrical connection assembly of claim 10, wherein the bulkhead connector element is a portion of a detonator head portion of the second detonator.

13. The electrical connection assembly of claim 1, wherein the pressure bulkhead extends at least from the first end to the second end of the tandem seal adapter.

14. An electrical connection assembly for establishing an electrical connection with a detonator in a downhole tool, the electrical connection assembly comprising:

a tandem seal adapter having a first end, a second end and a bore that extends through the tandem seal adapter from the first end to the second end;

a pressure bulkhead having a body extending between a first end and a second end, the body of the pressure bulkhead is sealingly received in the bore of the tandem seal adapter, the pressure bulkhead also including a pin connector assembly configured to relay an electrical signal between the first end of the pressure bulkhead and the second end of the pressure bulkhead; and a set of inner components within the downhole tool that includes the detonator, the detonator being electrically connected to the pin connector assembly adjacent the inner end of the pressure bulkhead, wherein the tandem seal adapter and the pressure bulkhead are configured to seal the inner components from an environment adjacent the second end of the tandem seal adapter, wherein the pin connector assembly includes a spring loaded contact pin, a portion of the spring loaded contact pin extends from the bulkhead body.

15. The electrical connection assembly of claim 14, wherein it is not possible to interrupt the electrical signal between the first end and the second end of the pressure bulkhead.

16. The electrical connection assembly of claim 14, wherein the detonator comprises:

a detonator head that includes a signal-in connector element configured to be contacted by an inner contact pin of the pin connector assembly.

17. The electrical connection assembly of claim 16, further wherein the detonator head includes a through wire connector element and a ground connector element.

18. The electrical connection assembly of claim 16, wherein the detonator further includes a detonator body extending from the detonator head and further wherein the detonator is not physically joined to the electrical connection assembly.

19. The electrical connection assembly of claim 14, wherein the pin connector assembly further comprises:

an inner contact pin having a first radius, wherein the spring loaded contact pin has a second radius, and each of the inner contact pin and the spring loaded contact pin having a pin head portion positioned within the pressure bulkhead, each pin head portion having a radius greater than the first radius and the second radius; and a biasing member positioned within the pressure bulkhead and abutting the pin head portion of the inner contact pin.

20. The electrical connection assembly of claim 19, wherein the biasing member exerts a force on the pin head portion of the inner contact pin.

21. The electrical connection assembly of claim 14, wherein the pin connector assembly further comprises:

an inner contact pin opposite the spring loaded contact pin;

an inner body positioned between the inner contact pin on one end and the spring loaded contact pin on an opposite end; and a first biasing member and a second biasing member positioned within the pressure bulkhead between the inner contact pin on the one end and the spring loaded contact pin on the opposite end, each of the first biasing member and the second biasing member exerting a force on the inner body.

* * * * *